US007774970B1

(12) United States Patent
McGarry

(10) Patent No.: US 7,774,970 B1
(45) Date of Patent: Aug. 17, 2010

(54) METHOD FOR INDICATING LOADED FIREARM CHAMBER

(75) Inventor: James McGarry, Prescott Valley, AZ (US)

(73) Assignee: Sturm, Ruger & Co., Inc., Southport, CT (US)

( * ) Notice: Subject to any disclaimer, the term of this patent is extended or adjusted under 35 U.S.C. 154(b) by 275 days.

(21) Appl. No.: 12/150,719

(22) Filed: Apr. 30, 2008

Related U.S. Application Data

(60) Division of application No. 10/949,480, filed on Sep. 24, 2004, now Pat. No. 7,383,655, which is a continuation-in-part of application No. 10/825,509, filed on Apr. 15, 2004, now abandoned.

(51) Int. Cl.
*F41A 9/53* (2006.01)

(52) U.S. Cl. ..... 42/1.05

(58) Field of Classification Search ..... 42/1.05
See application file for complete search history.

(56) References Cited

U.S. PATENT DOCUMENTS

| | | | | | |
|---|---|---|---|---|---|
| 808,463 | A * | 12/1905 | Luger | 42/16 |
| 891,438 | A * | 6/1908 | Peard | 42/1.05 |
| 2,100,273 | A * | 11/1937 | Skandera | 42/1.05 |
| 2,102,195 | A * | 12/1937 | Conniffe | 42/1.05 |
| 2,850,827 | A * | 9/1958 | Luciani | 42/1.05 |
| 4,100,691 | A * | 7/1978 | Wicklund | 42/1.05 |
| 4,103,639 | A * | 8/1978 | Otteson | 42/1.05 |
| 4,494,329 | A * | 1/1985 | Post et al. | 42/1.05 |
| 5,052,139 | A * | 10/1991 | Marzocco | 42/1.05 |
| 5,410,831 | A * | 5/1995 | Felk | 42/25 |
| 6,256,915 | B1 * | 7/2001 | da Silveira | 42/1.05 |
| 6,857,213 | B2 * | 2/2005 | Fluhr | 42/1.05 |
| 2003/0230020 | A1 * | 12/2003 | Christiansen | 42/1.05 |
| 2005/0016048 | A1 * | 1/2005 | Fluhr | 42/1.05 |

* cited by examiner

*Primary Examiner*—Troy Chambers
(74) *Attorney, Agent, or Firm*—Duane Morris LLP; Frank J. Spanitz

(57) ABSTRACT

A pistol including a loaded chamber indicator to identify the presence of a cartridge loaded in the firing chamber. The pistol may generally include a barrel, a receiver attached to the barrel thereby defining a barrel-receiver assembly, and a chamber associated with the barrel-receiver assembly. An indicating element is provided which in one embodiment may be pivotally mounted in the barrel-receiver assembly. The indicating element is displaceable in response to contact by the cartridge from a first position which may in one embodiment correspond to an absence of a cartridge loaded in the chamber, to a second position which may in one embodiment correspond to a presence of a cartridge loaded in the chamber. A biasing member, such as a spring, may be provided to bias the indicating element towards the first position. In one embodiment, the indicating element protrudes outwards from the exterior of the pistol in response to contact by the cartridge rim to provide a visual and tactile indication of a loaded chamber condition to a user of the pistol.

20 Claims, 18 Drawing Sheets

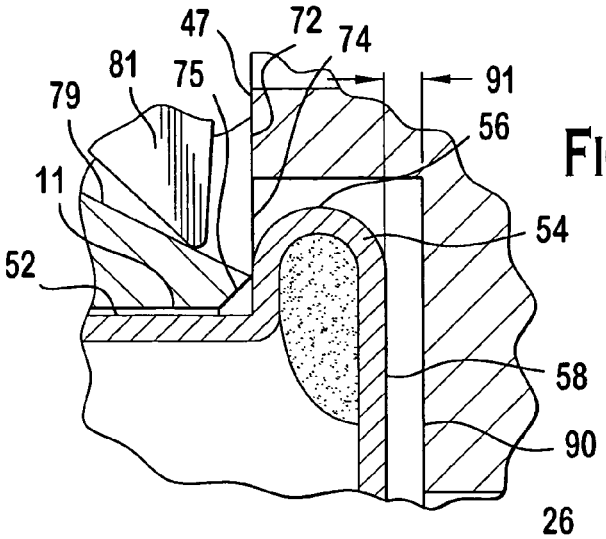
FIG. 3B
FIG. 4
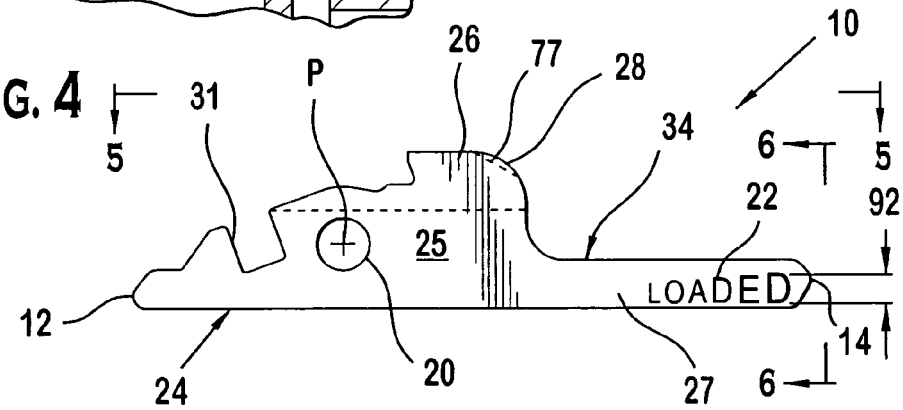
FIG. 5
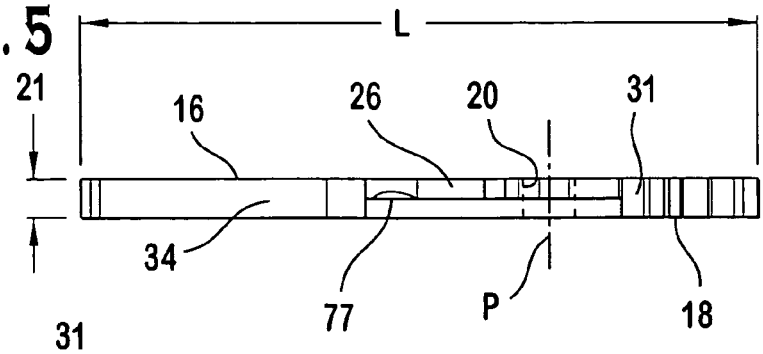
FIG. 5A
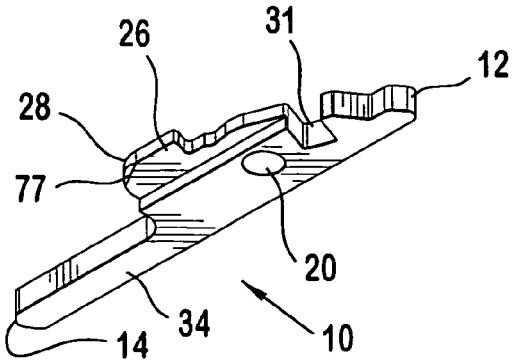
FIG. 6
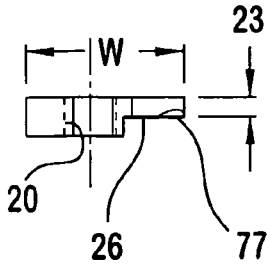

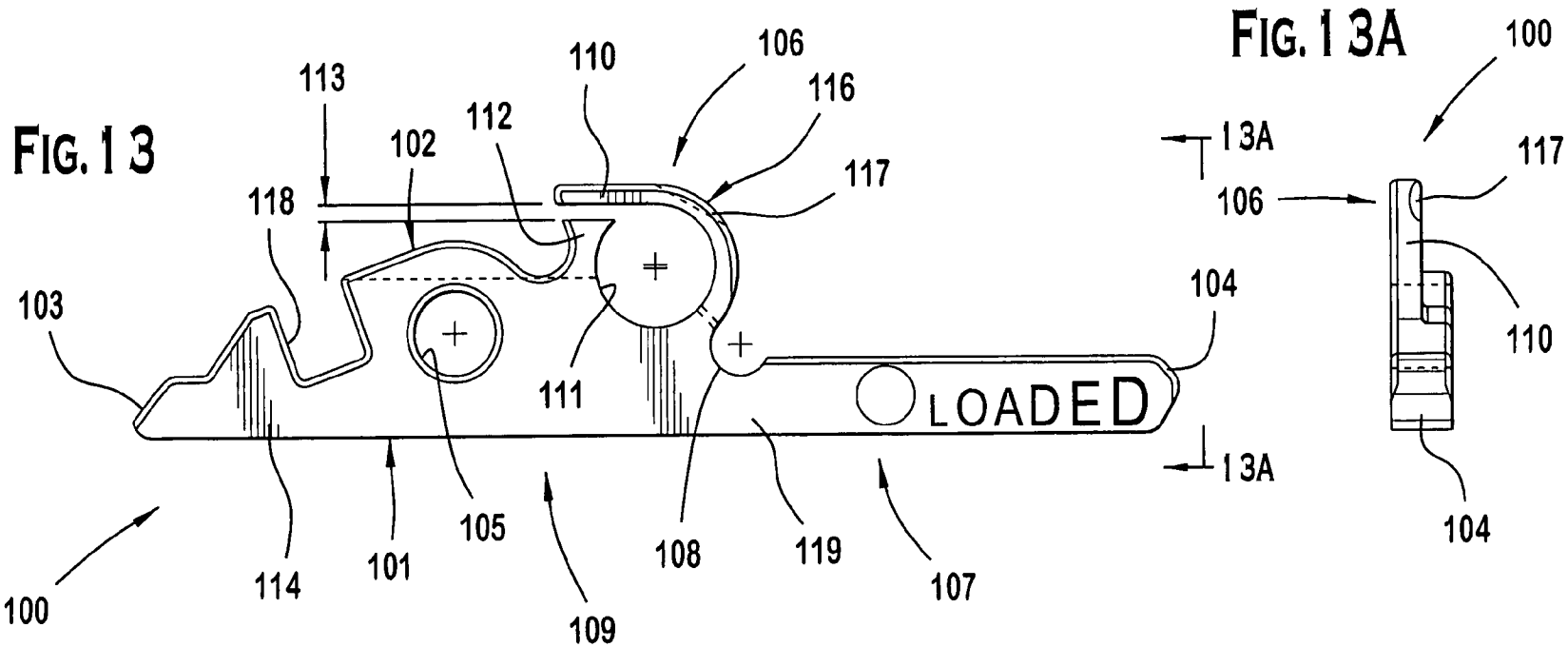
FIG. 13A
FIG. 13
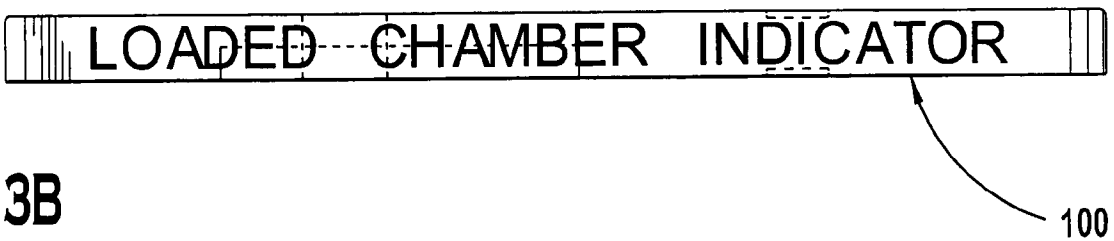
FIG. 13B

LOADED
LOADED CHAMBER INDICATOR
132
133
134
135
136
137
138
139
140
141
142
143
144
145
146
149a
149b
18A
18B
18C

METHOD FOR INDICATING LOADED FIREARM CHAMBER

CROSS-REFERENCE TO RELATED APPLICATIONS

This is a divisional of and claims priority to copending U.S. patent application Ser. No. 10/949,480 filed Sep. 24, 2004, entitled "Pistol with Loaded Chamber Indicator," which is a continuation-in-part of U.S. patent application Ser. No. 10/825,509 filed Apr. 15, 2004 (now abandoned), both of which are incorporated herein by reference in their entireties.

BACKGROUND OF THE INVENTION

The present invention generally relates to firearms, and more particularly to an improved device suitable for use with, but not limited to rimfire-type cartridges to indicate the presence of a cartridge in the chamber of a pistol (i.e., a "loaded chamber").

While the loaded condition of a firearm's chamber is customarily and most positively checked by the user opening the action and visually observing the presence of a cartridge therein, there have been prior devices which attempt to augment this procedure by providing a mechanical device to signal the chamber's state of readiness, particularly in military firearms where opening the chamber and observing the loaded condition of same may not be practical or possible due to the need for stealth. In a known loaded chamber indicator, an opening or window is cut into the rear portion of the barrel or chamber wall. The opening extends radially inwards from the side of the barrel and through the barrel's rear face against which the rim of a cartridge abuts when a cartridge is loaded into the barrel bore. An elongated thin elastic clip is provided that is fixed to the front portion of the barrel at one end. At the opposite end, the clip has a small projection that protrudes through the window in the barrel to contact the side of the cartridge casing when a cartridge is loaded into the barrel. The clip, however, is physically deflected outwards only by a very small amount by the cartridge casing. Moreover, the clip does not protrude beyond the exterior surface of the pistol in a loaded chamber condition, making the indicator not readily noticeable. Both of these factors make it difficult for a pistol user to visually distinguish a loaded chamber condition from an empty chamber condition by use of such devices.

In another known indicator; a very small viewing window or port is similarly cut into in the barrel or chamber wall of a pistol to allow the presence of the cartridge casing in the barrel bore to be seen through the window. Dirt, unburned gun powder residue, carbon build-up, and grease may obscure the small viewing ports and render them ineffective. The viewing port type indicators are also not useable at night or in other darkened environments.

A drawback of the foregoing known loaded chamber indicators is that they are also not suitable for use with all types of known self-contained cartridges currently on the market today because the window cutouts in the rear barrel or chamber reduce structural support of the cartridge casing and rim. In particular, the foregoing indicators are not well-suited for the very popular rimfire-type cartridges, such as the .22 Long Rifle, which optimally require substantial structural support of the cartridge casing and rim during firing. In a rimfire cartridge, the impact-sensitive primer material, which is used to ignite the propellant powder (i.e., gunpowder), is distributed inside and around the base of the cartridge casing in the rim. The rim is a relatively thin and narrow laterally-protruding hollow annular structure disposed around the circumference of the cartridge casing at its base. An annular space is contained inside the rim for holding the primer material. Striking the rim from the rear (such as with a firing pin) crushes and flattens the rim together against the rear face of the barrel or chamber. This "squeezing" deformation of the rim creates internal friction in the primer material sandwiched in the narrow annular space within the rim, and ignites the primer which in turn sets off the propellant powder. Accordingly, the casing in the base area, and in particular the rim of the cartridge casing, are intentionally made relatively thin and weak by structural design to be readily deformable. Therefore, a rimfire-type pistol, to provide maximum support to the base and rim of the cartridge to prevent the fragile rimfire casing from bursting during firing, should preferably not contain cutouts in the barrel or chamber area.

The known loaded chamber indicators discussed above all require cutting away of cartridge support provided by the barrel or chamber to allow those indicators to function properly. There has never been a loaded chamber indicator in the prior art that functions in a truly satisfactory fashion on firearms chambered for rimfire-type ammunition, which comprise a large percentage of the firearms sold. Accordingly, there is a need for a loaded chamber indicator that does not undermine support of a cartridge during firing and, in particular, one which functions satisfactorily with rimfire-type ammunition such as the .22 Long Rifle.

SUMMARY OF THE INVENTION

A preferred embodiment provides a moveable loaded chamber indicator for a pistol that advantageously does not require cutting away of the rear barrel or chamber, thereby providing substantial structural support of the cartridge casing when the cartridge is loaded in the barrel or chamber. The preferred embodiment further advantageously provides a loaded chamber indicator that is more readily noticeable to a pistol user from a visual and tactile standpoint than known indicators.

In a preferred embodiment, the loaded chamber indicator operates by contact with the cartridge rim which remains outside of, and to the rear of or behind the chamber when the cartridge is loaded therein. Accordingly, the structural integrity of the chamber is not compromised by any openings cut through the chamber walls into the chamber like the known indicators discussed above. Therefore, the relatively fragile rimfire cartridge casing may be substantially and properly supported by the chamber.

In a rimfire cartridge, striking the cartridge rim from the lateral or side direction (instead of from the normal rear firing direction as with a firing pin) does not ignite the primer because the "squeezing" deformation of the rim needed to ignite the primer material (discussed above) is not created by impacting the rim from the side. In addition, the arched shape of the rim presented in the lateral direction makes the rim inherently stronger and more resistant to deformation from a blow to the side. Accordingly, the side of the cartridge rim which may conveniently be used to activate the indicator.

A pistol designed according to the preferred embodiment includes a barrel, a housing which may be a receiver preferably coupled to the barrel to define a barrel-receiver assembly, and a chamber capable of holding a cartridge and which is operably associated with the barrel-receiver assembly. In a preferred embodiment, the chamber may be a cylindrical longitudinal bore which may be contained in a chamber block having sidewalls and a rear surface for abuttingly receiving a cartridge having rim. Preferably, the rear surface of the chamber block surrounding the chamber opening is uninterrupted by cutouts and forms a continuous circumferential seat for abuttingly contacting and supporting the rim of the cartridge. In one embodiment, the chamber is sized for receiving a .22 caliber cartridge.

An indicating element is provided which preferably operates off contact with the rim of the cartridge. More preferably, in the preferred embodiment, the indicating element operates off contact with the side of the cartridge rim. The indicating element may be pivotally mounted to the barrel-receiver assembly at a pivot defining a pivot point. Preferably, the indicating element is moveable and displaceable in response to contact by the cartridge from a first inactivated position or location, which may correspond to an absence of a cartridge fully-loaded in the chamber (i.e. an unloaded-chamber-indication position), to a second activated position or location, which may correspond to the presence of a cartridge loaded in the chamber (i.e. a loaded-chamber-indication position). In one embodiment, at least a portion of the indicating element protrudes outwards and away from exterior surface of the barrel-receiver assembly in the second position in response to contact by the cartridge. This provides both a visual and tactile indication that a cartridge is loaded in the chamber.

In one embodiment, the indicating element may have a sensor surface configured to contact and detect the cartridge, and a signal area to identify and communicate the presence of a cartridge in the chamber. The sensor surface may be a cam. Preferably, the signal area may protrude outward and away from the exterior surface of the pistol in the second loaded-condition-indication position. The signal area has an ornamental shape which in one embodiment may also include an ornamental written, graphic, colored, and/or other suitable indicia or combination thereof on one or more of its surfaces to denote a "loaded chamber" condition.

In one embodiment, the indicating element may be one-piece and generally rigid in its overall construction.

According to another preferred embodiment, energy-absorbing loaded chamber indicating elements are provided. These energy-absorbing indicating elements may be generally configured and function as the indicating element described above, but advantageously are capable of at least partially absorbing the force of a lateral or side impact to the indicating element when in a position protruding from the pistol. Generally, this may be achieved by providing an indicating element whose design in itself is at least partially deformable or flexible, and movable in response to such a lateral impact.

In one embodiment, an energy-absorbing indicating element may include a flexible portion which in a preferred embodiment may be generally configured as a cantilevered spring arm. In one arrangement, the spring arm may form the sensor portion of the indicating element and be located to operably contact the cartridge rim. Alternatively, the spring arm may form part of the signal portion or area which protrudes from the pistol when a cartridge is present in the chamber to signal a loaded chamber condition. In yet another alternative, both the sensor portion and signal portion signal area may each be configured and function as spring arms. The energy-absorbing indicating element may be one-piece in construction or may be composed of two or more components operably connected together.

In another alternative embodiment, therefore, a two-piece energy-absorbing indicating element is provided. Preferably, the two-piece indicating element may be spring-loaded and collapsible being movable from an expanded position to a collapsed position to absorb the energy of a lateral strike or impact which is stored in compressing at least one spring. The two-piece collapsible indicating element may generally include a sensing member for sensing the presence of a cartridge in the chamber and a signal member for communicating the presence of a loaded chamber condition to a pistol user. Preferably, sensing member and signal member are movable and displaceable in relation to one another. The collapsible indicating element may include at least one biasing member, and more preferably at least two biasing members such as helical springs. One spring may be used to bias the indicating element inwards towards the chamber for contacting the cartridge in the same manner as described above. The other spring may be provided for controlling the displacement of the sensing and signal members with respect to each other and for absorbing the energy of a lateral impact to the protruding indicating element. The indicating element is movable from an expanded position corresponding to the absence of an external lateral force on the indicating element to a collapsed position corresponding to the presence of an external lateral force on the indicating element. This latter spring returns the indicating element to the expanded condition when the external force is removed.

Broadly speaking, the foregoing rigid loaded chamber indicating element and energy-absorbing indicating elements described above all provide a surface which functions to contact the rim of a cartridge loaded in the chamber and which surface is movable from a first position to a second position. At least part of the respective indicating element protrudes from the exterior of the pistol in the second position to visually and tactilely communicate a loaded chamber condition to a pistol user. The energy-absorbing loaded chamber indicating elements further provide structures which function to be at least partially flexible and movable in response to a lateral impact or force imparted to the side of the indicating element so as to absorb at least some of the impact energy.

According to another aspect of the preferred embodiment, the pistol includes a bolt that is slidably mounted in the barrel-receiver assembly. The bolt is preferably slidable in a forward direction towards the front of the pistol and in a rearward direction towards the rear of the pistol, as further described below. In one embodiment, the bolt has a recess configured and arranged to receive the indicating element. In another embodiment, the barrel-receiver assembly similarly has a cutout configured and arranged to receive the indicating element.

As the terms are used herein, the "front" of a pistol is defined as the barrel end and the "rear" of a pistol is defined as the handle or grip end of a pistol. Also as the terms may be used herein with respect to orientation using the pistol as a frame of reference to direction, "forward" indicates a direction towards the muzzle (front of barrel) end of the pistol and "rearward" indicates a direction towards the handle or grip end of the pistol. "Downwards" indicates a direction towards the bottom or underside of the pistol and "upwards" indicates a direction towards the top of the pistol opposite the bottom or underside.

In the foregoing definitions and descriptions provided herein, any reference to either orientation or direction is intended primarily for the convenience in describing the preferred embodiment and is not intended in any way to limit the scope of the present invention thereto.

According to another aspect of the preferred embodiment, a biasing member, such as a spring, may be provided in one embodiment which is associated with the loaded chamber indicating element. The spring may be disposed in the barrel-receiver assembly and interacts with the indicating element to preferably bias the indicating element towards the first position described above (i.e., absence of a fully-loaded cartridge in the chamber). In one embodiment, the biasing member may be a helical spring.

Another preferred embodiment of a pistol with a loaded chamber indicator includes: a frame; a trigger mounted to the frame; a barrel-receiver assembly mounted to the frame and having an exterior surface and defining a chamber that receives a cartridge having rim; a continuous circumferential seat surrounding the chamber that supports the rim of the cartridge when the entire body of the cartridge is disposed in the chamber; a bolt slidably disposed in the barrel-receiver assembly; a surface movable from a first position to a second position when contacted by the rim of the cartridge; and a means for moving the surface from the first position to the second position. In one embodiment, the movable surface may be shaped like a cam to facilitate smooth contact with the rim of the cartridge.

In one embodiment, the foregoing means for moving the surface may be a rigid element, which may be pivotally mounted to the barrel-receiver assembly. In another embodiment, the means for moving the surface may be an element having a deformable portion capable of deforming in response to an external lateral impact to the means to absorb at least some of the impact energy. In one embodiment, the deformable portion is a cantilevered spring arm. In yet another embodiment, the means for moving the surface may be an element having a sensing member for detecting the presence of a cartridge in the chamber and a signal member for communicating the presence of the cartridge to a pistol user. The signal member is displaceable or movable with respect to the sensing member upon the application of an external lateral impact to the means. A biasing member may be provided to control the displacement of the signal member with respect to the sensing member and further may function to absorb at least some of the lateral impact energy imparted to the means. In still another embodiment, the means for moving the surface may be a collapsible element movable in response to an applied external lateral force on the element. The element may be movable from an expanded position corresponding to an absence of the lateral force on the element to a collapsed position corresponding to a presence of the lateral force on the element. The element having a planar physical size or spread which is larger or broader (i.e., covers more planar surface area) in the expanded position than in the collapsed position. In one embodiment, a spring may be provided to control the expanding and collapsing movement of the element. The element functions to at least partially absorb and then release the energy from the external lateral impact in moving from the collapsed to expanded positions, respectively. In another embodiment, the means for moving the surface may be a collapsible element movable in response to an applied external lateral force on the element. The element is movable from an expanded position corresponding to an absence of the lateral force on the element to a collapsed position corresponding to a presence of the lateral force on the element. The element has a physical size which is broader or larger in the expanded position than in the collapsed position. In one embodiment, the collapsible element further includes a first member and a second member displaceable with respect to the first member, and a biasing member arranged to control the displacement of the second member in response to the application of the lateral force on the element.

A method of indicating a loaded pistol chamber is also provided including locating the rim of a cartridge on a continuous circumferential seat and displacing an element to a loaded-condition-indication position with the rim of the cartridge. In one embodiment, the method further includes protruding at least a portion of the indicating element outwards from an exterior surface of the pistol to provide a user of the pistol with a visual and tactile indication that a cartridge is loaded in the chamber. In yet another embodiment, the method includes the step of retracting the indicating element inside the pistol to an unloaded-chamber-indication position in the absence of contact between the indicating element and cartridge rim.

Although the preferred embodiment of a loaded chamber indicator will be described for convenience with reference to a pistol having a receiver that is fixed on the grip frame, and a bolt that is slidably movable within the receiver in response to recoil forces developed during firing, the invention is not limited in its applicability by such reference. Accordingly, the preferred embodiment may also be used in pistols having a movable bolt in the form of a slide that is slidably mounted on the grip frame to move in response to the recoil forces developed during firing. Although the preferred embodiment of a loaded chamber indicator is particularly suited for use with pistols that utilize rimfire-type ammunition, the preferred embodiment may be beneficially used in centerfire cartridge-type pistol applications as well.

BRIEF DESCRIPTION OF THE DRAWINGS

The features of the preferred embodiments will be described with reference to the following drawings where like elements are labeled similarly, and in which:

FIG. 3B is a detailed cutaway view from FIG. 3A showing a rimfire cartridge with primer material contained in the rim and loaded in the chamber before firing;

FIG. 4 is a top view of the indicating element of FIG. 1;

FIG. 5 is a right side elevational view of the indicating element of FIG. 4 taken along line 5-5 in FIG. 4;

FIG. 5A is a bottom perspective view of the indicating element of FIG. 5;

FIG. 6 is a rear end view of the indicating element of FIG. 1 taken along line 6-6 in FIG. 4;

FIG. 13 is a top view of second embodiment of an indicating element useable in the pistol of FIG. 1;

FIG. 13A is a side cross-sectional view of the indicating element of FIG. 13 taken along line 13A-13A in FIG. 13;

FIG. 13B is a front elevational view of the indicating element of FIG. 13;

FIGS. 15A-17A show the same views as and correspond to FIGS. 15-17, but with the indicating element and cartridge disembodied from the pistol.

FIGS. 21A-23A show the same views as and correspond to FIGS. 21-23, but with the indicating element and cartridge disembodied from the pistol.

DESCRIPTION OF THE PREFERRED EMBODIMENTS

Figure 1:
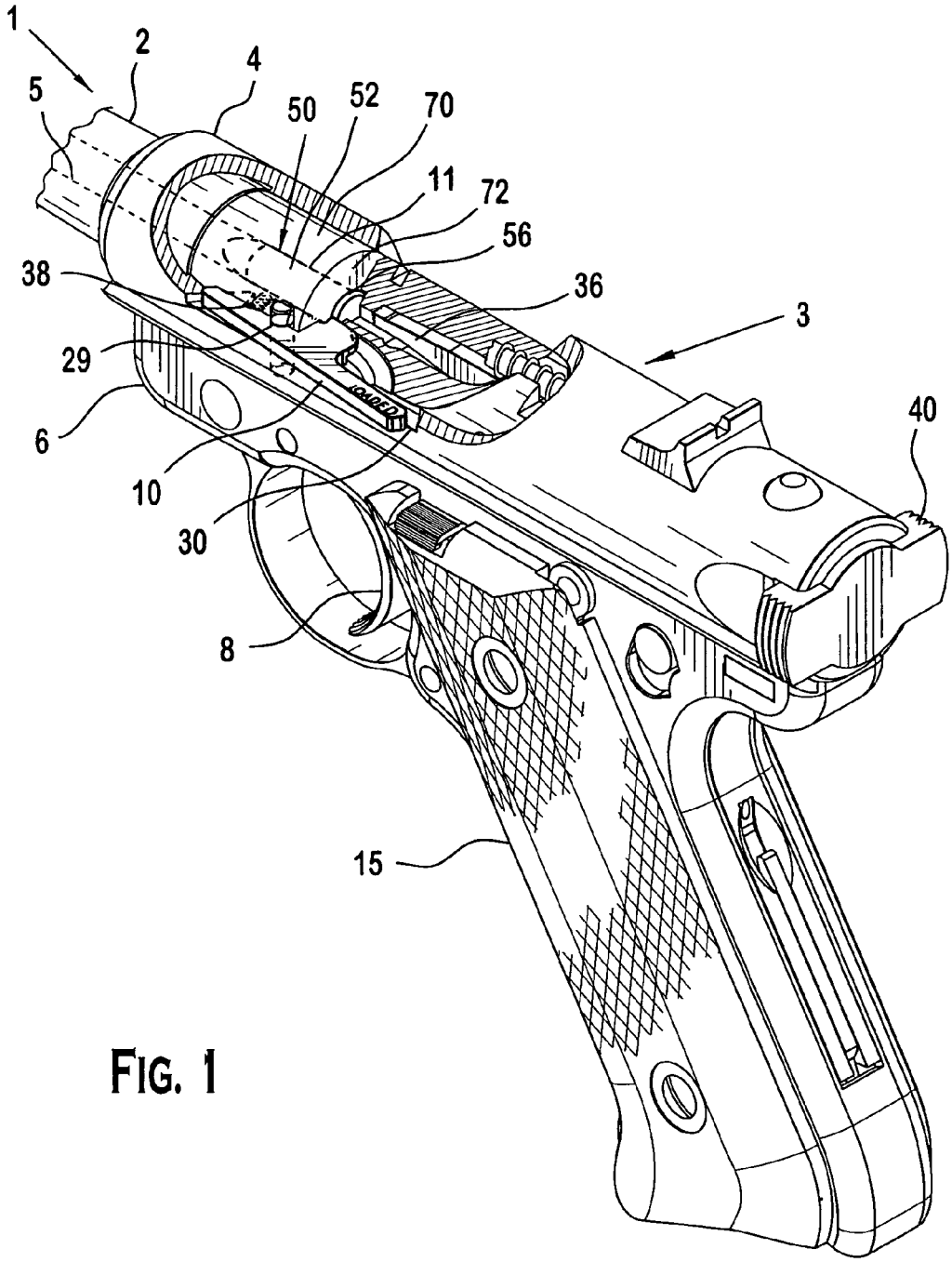
FIG. 1 is a rear perspective view of a preferred embodiment of a firearm in the form of a pistol and in which the pistol has been partially cut away to show the rear of the chamber and a cartridge rim contacting a loaded chamber indicator.
Figure 2:
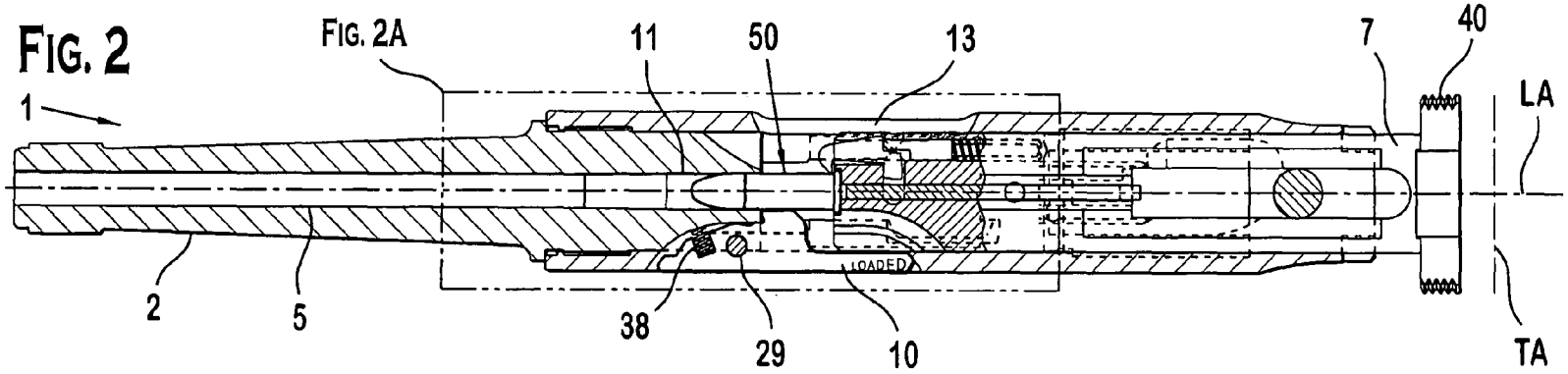
FIG. 2 is top cross-sectional view taken along line 2-2 in FIG. 1A, but instead showing a cartridge partially loaded into the chamber.
Figure 3:
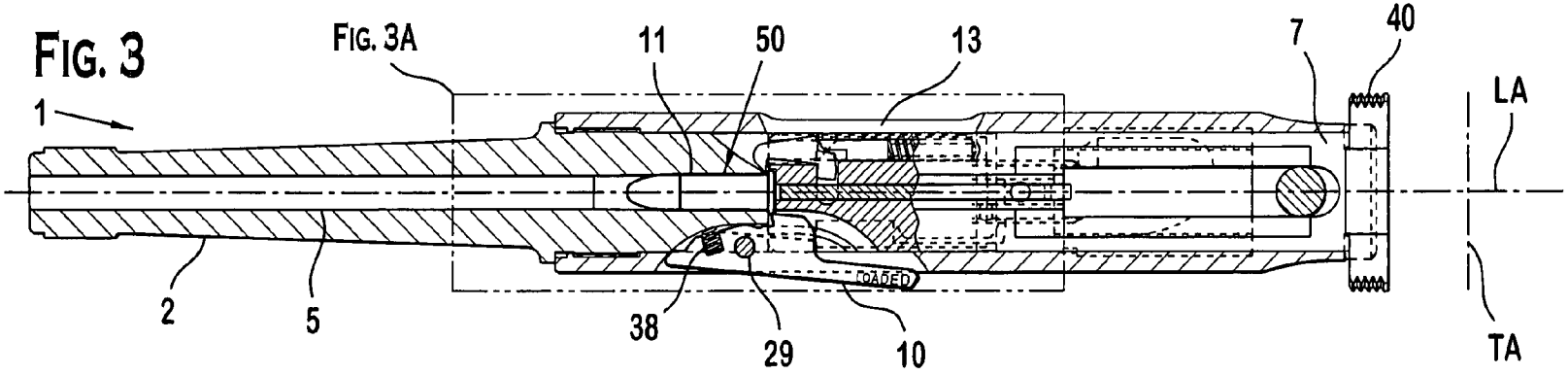
FIG. 3 is the top cross-sectional view taken along line 3-3 in FIG. 1A showing a cartridge fully loaded into the chamber.

Referring generally to FIGS. 1-3, a preferred embodiment will now be described for convenience with reference to a rimfire-type pistol in the form of an autoloading pistol. It will be appreciated that the preferred embodiment is equally applicable for use with other type pistols including, without limitation, non-autoloading pistols, centerfire-type cartridge firing pistols, etc. In addition, the preferred embodiment may be used in non-firearm applications where a tactile and visual indication of a component operating position is desired.

Pistol 1 includes a longitudinally-extending barrel 2 with longitudinal bore 5 therethrough and a generally hollow-structured receiver 4 in operational relationship with barrel 2. In a preferred embodiment, receiver 4 is disposed adjacent to and preferably attached to barrel 2; the combination defining a barrel-receiver assembly 3. Receiver 4 has an exterior surface 80 and an interior surface 82 defining a cavity 86 therein (see, e.g., FIGS. 2A and 3A).

Barrel 2 defines a longitudinal axis "LA" for pistol 1 passing through barrel bore 5. A transverse axis "TA" is defined perpendicular to the longitudinal axis LA. The barrel-receiver assembly 3 is preferably mounted to a grip frame 6 that includes a grip frame handle portion 15, which in one embodiment may hold a removable magazine (not shown) capable of holding and dispensing a plurality of cartridges. Pistol 1 further includes a trigger 8 for discharging the pistol.

A chamber block 70 associated and in operable relationship with barrel-receiver assembly 3 may be provided adjacent to the rear of the barrel 2. Chamber block 70 may be integral with barrel 2 or a separate component attached to barrel 2. Chamber block 70 preferably includes a chamber 11 which in the preferred embodiment may be a cylindrical bore. Chamber 11 is positioned and arranged to receive and hold a cartridge 50 which may include a cartridge casing 52 and an annular laterally-protruding rim 54 disposed around the rear or base 58 of the cartridge (best seen in FIG. 3B). In the case of a rimfire cartridge (as shown in FIG. 3B), the primer material is distributed and contained inside the rim.

Chamber 11 defines a longitudinal chamber centerline 84 which coincides with longitudinal axis LA of the pistol and in which chamber centerline 84 is concentrically aligned with bore 5 of barrel 2. Chamber 11 preferably communicates with both bore 5 of barrel 2 to its front, and interior receiver cavity 86 to its rear to permit a cartridge to be loaded and chambered from the magazine into chamber 11, and ultimately discharged from pistol 1 through barrel 2. Accordingly, chamber 11 functions to hold cartridge 50 in preparation for discharging pistol 1.

Figure 1A:
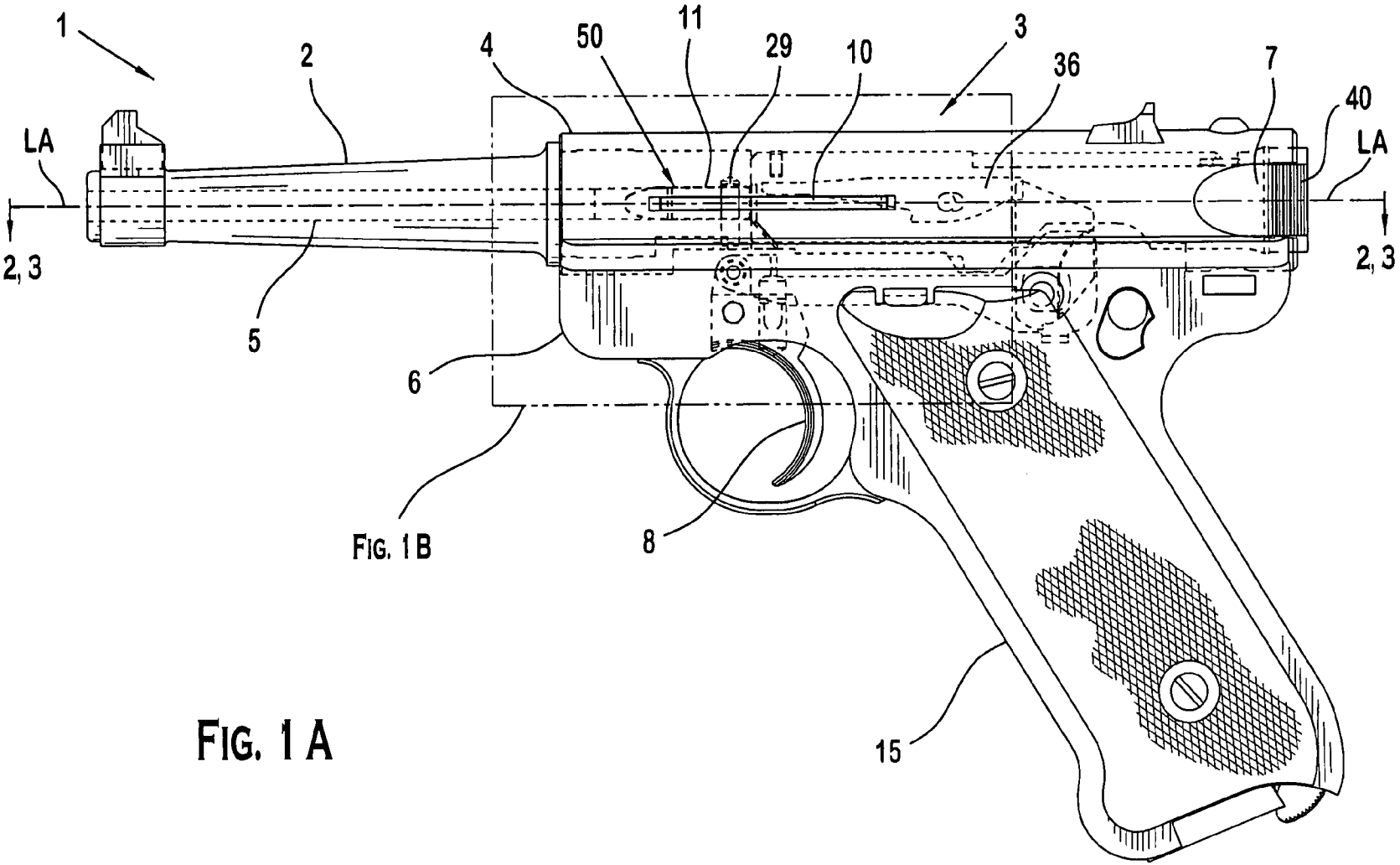
FIG. 1A is a left side elevational detail view of the pistol of FIG. 1.

In one embodiment, chamber block 70 may further includes sidewalls 76 and a rear surface 72. In a rimfire cartridge 50, rim 54 protrudes radially outwards beyond cartridge casing 52 (see FIGS. 2A, 3A, and particularly 3B) and has a larger outside diameter than the casing. Rear surface 72 includes a circumferential seat 74 which preferably surrounds chamber 11. Cartridge rim 54 abuts against circumferential seat 74 when cartridge 50 is loaded in chamber 11 (see FIGS. 1A and 3A). Preferably, circumferential seat 74 is continuous and uninterrupted by cutouts for a loaded chamber indicator to substantially support cartridge rim 54 and cartridge casing 52. Also preferably, chamber block sidewall 76 does not have any openings or windows cut therethrough for a loaded chamber indicator to provide maximum and substantial support for cartridge casing 52 when cartridge 50 is loaded in chamber 11 and fired.

Figure 2A:
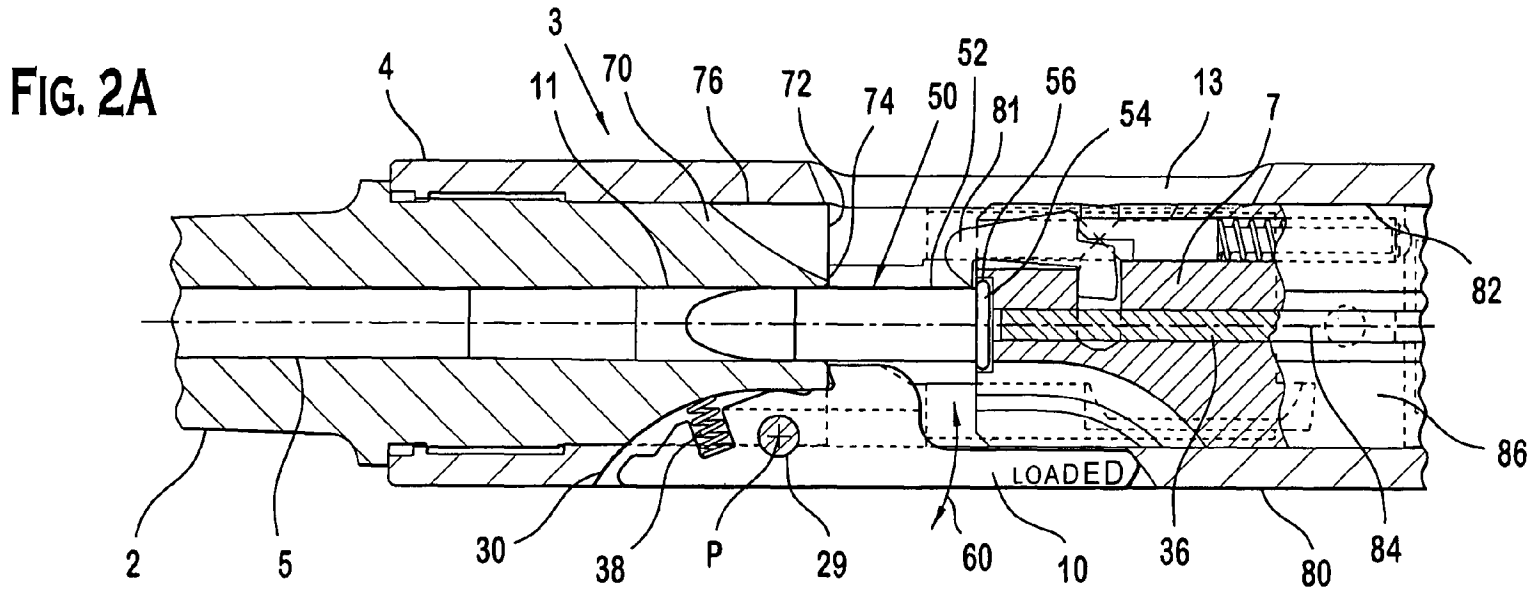
FIG. 2A is a top detailed view taken from FIG. 2.
Figure 3A:
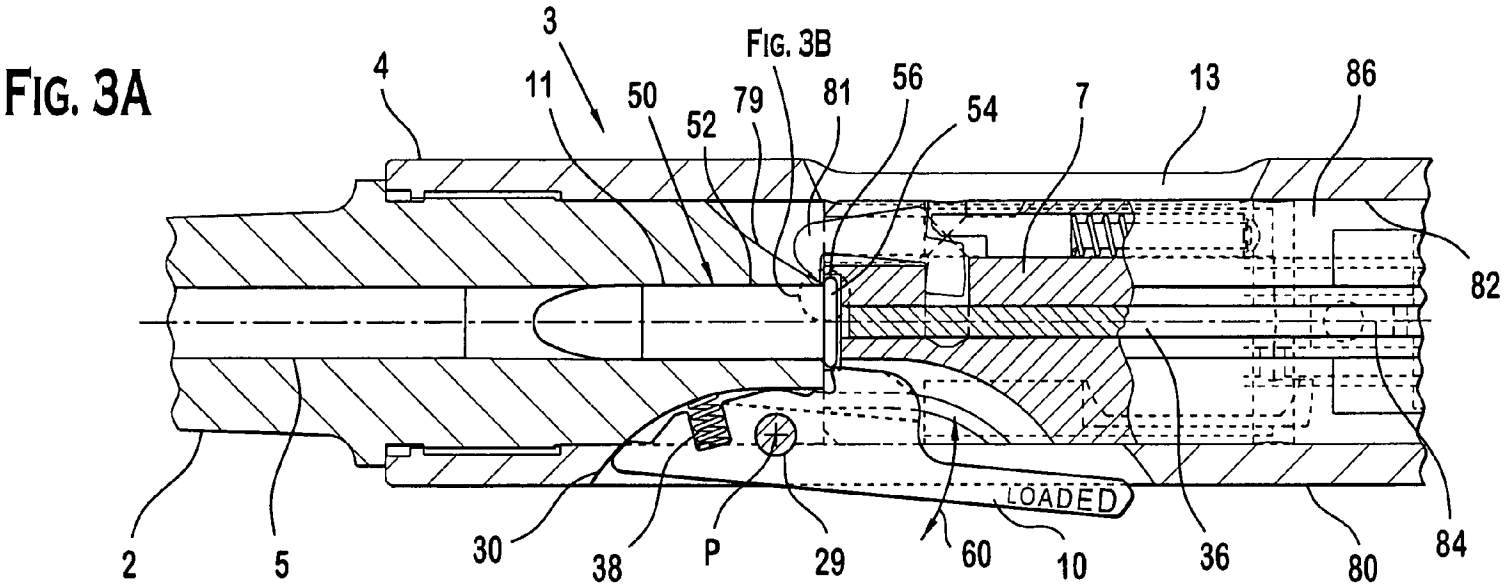
FIG. 3A is a top detailed view taken from FIG. 3.

In one embodiment (as best seen in FIG. 3B), circumferential seat 74 may include a slight chamfer 75 (e.g., typically about 0.010 inches) around the rear entrance opening to chamber 11 in rear chamber block surface 72 to facilitate loading of cartridge 50 before firing a cartridge from pistol 1 (best seen in FIGS. 2A and 3A). If a chamfer 75 is provided, however, it should be noted that the structural integrity of circumferential seat 74 is not adversely affected and seat 74 still substantially and sufficiently supports cartridge rim 54 and cartridge casing 52 to seal chamber 11.

A spring-biased hook-like extractor 81 may be provided which removes a spent cartridge casing from chamber 11 by grasping the cartridge rim 54 after pistol 1 is discharged. The spent casing is subsequently ejected from pistol 1. A small extractor notch 79 (best seen in FIGS. 2A and 3A) may also be provided in chamber block 70 to further facilitate removal of a spent cartridge casing from chamber 11. Notch 79 is preferably angled towards the rear entrance to chamber 11 disposed in chamber block rear surface 72. However, notch 79 does not penetrate into chamber 11. Therefore, notch 79 does not adversely affect substantial and sufficient support of cartridge rim 54 and cartridge casing 52 during firing.

It will be appreciated that in an embodiment of pistol 1 intended to be used with centerfire cartridges (not shown), it is contemplated that cutout(s) may be made in circumferential seat 74 and/or sidewall 76 of chamber block 70. Centerfire cartridges have a deformable primer cup located in the center of the rear or bottom of the casing. The firing pin in a centerfire pistol is therefore positioned to strike the rear center of the cartridge at the primer cup. Accordingly, centerfire casings are typically strong in contrast to relatively fragile rimfire cartridges and do not require substantial support of the casing.

Chamber block 70 may have any suitable overall size and three-dimensional shape (e.g., square or rectangular block, cylindrical, etc.) so long as the chamber block is capable of housing a chamber 11 disposed therein.

Figure 7:
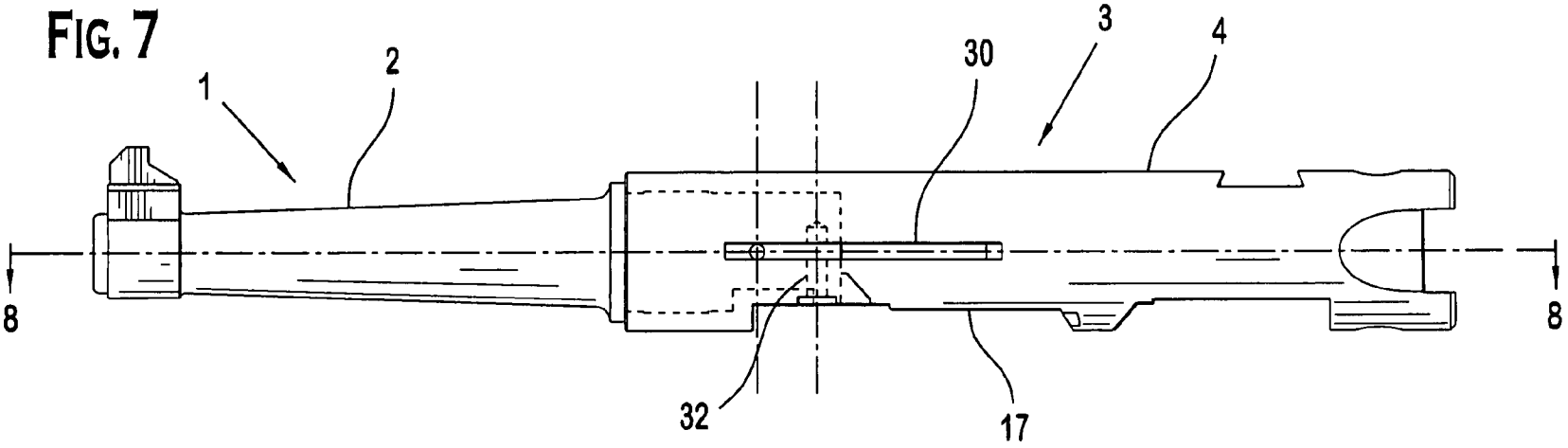
FIG. 7 is a left side elevational view of the barrel-receiver assembly of the pistol of FIG. 1.

Receiver 4 may further have a cartridge loading opening 17 as shown in FIG. 7 which communicates with grip frame 6 and the magazine therein (not shown) for loading cartridge 50 into chamber 11. Receiver 4 also preferably includes a cartridge ejector opening 13 (see, e.g., FIGS. 2-3) to allow a spent cartridge casing 52 to be ejected from pistol 1 after firing.

Figure 1B:
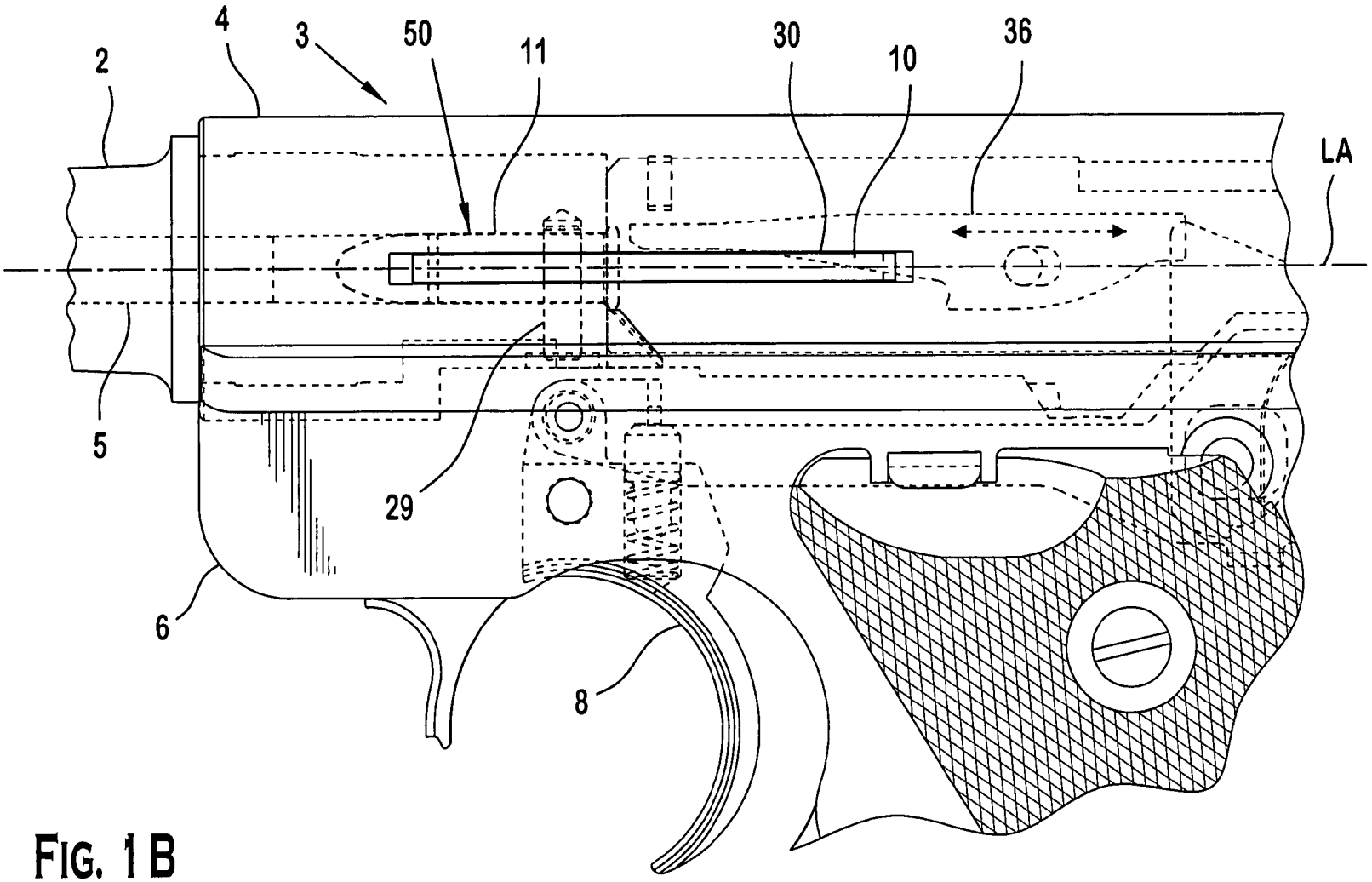
FIG. 1B is a left side view detail taken from FIG. 1A.

Pistol 1 further includes a firing pin 36 to strike the cartridge and discharge the pistol. Firing pin 36 has a longitudinally reciprocating forward and rearward motion and is mechanically actuated by trigger 8 (eventually) through various intermediate operable linkages. In the case of a rimfire cartridge, the rear of rim 54 must be struck and deformed by firing pin 36 (best seen FIGS. 1A and 1B) to ignite the primer and discharge pistol 1 (see Background of the Invention). Accordingly, in a rimfire-type pistol 1 as shown herein, firing pin 36 is preferably mounted and positioned in the pistol offset from centerline 84 of chamber 11 (see, e.g., FIGS. 1A and 1B) which coincides with longitudinal axis LA of pistol 1. More preferably, firing pin 36 is offset and positioned to strike a portion of cartridge rim 54 from the rear during the firing pin's forward motion. This crushes rim 54 sandwiched between rear surface 72 of chamber block 70 and firing pin 36, thereby causing the needed "squeezing" deformation of rim 54 (as discussed above) which ignites the primer therein and sets off the propellant powder to discharge pistol 1.

Figure 12:
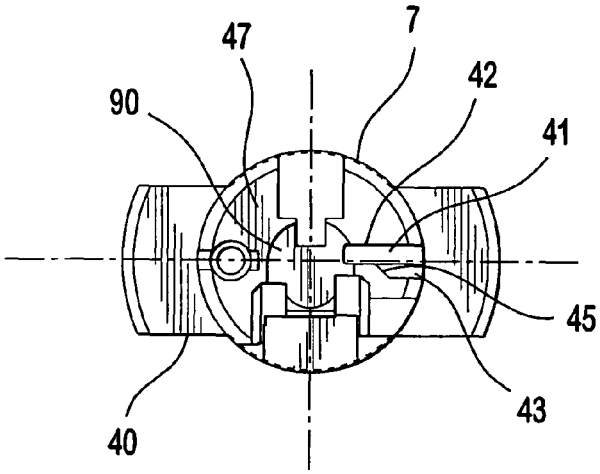
FIG. 12 is a front end view of the bolt of FIG. 10 taken along line 12-12 in FIG. 10.
Figure 10:
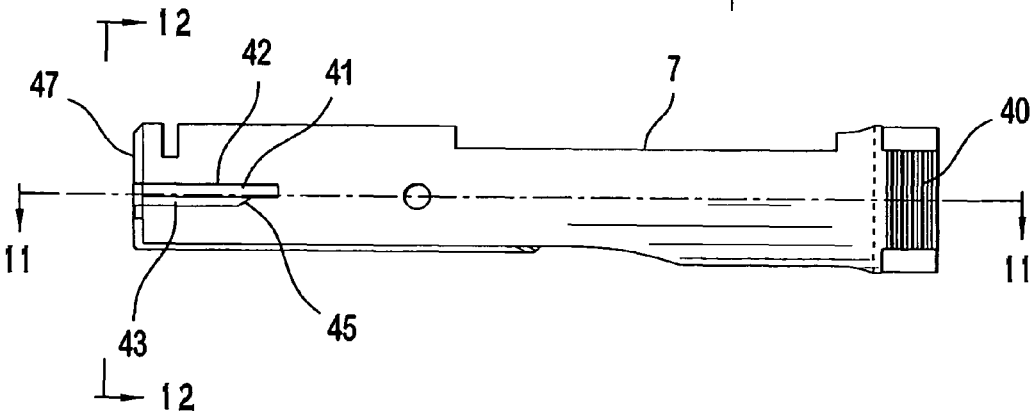
FIG. 10 is a left side elevational view of the bolt of the pistol of FIG. 1.
Figure 11:
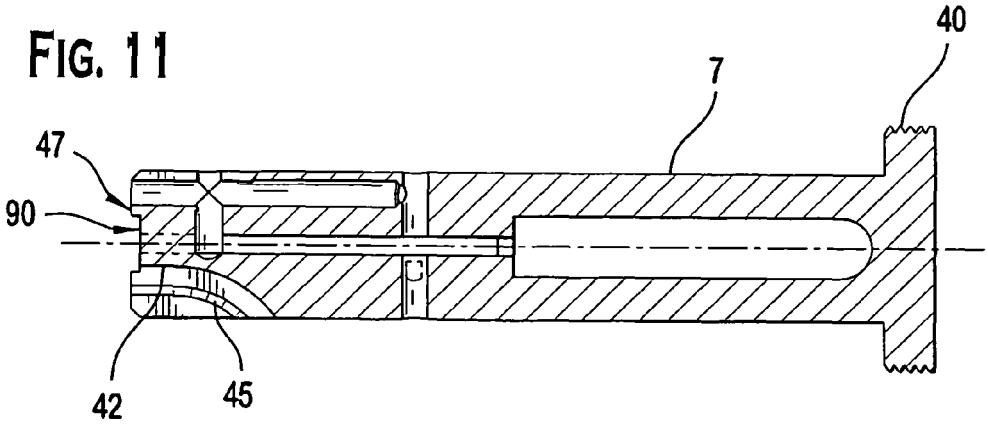
FIG. 11 is a top cross-sectional view of the bolt of FIG. 10 taken along line 11-11 in FIG. 10.
Figure 14:
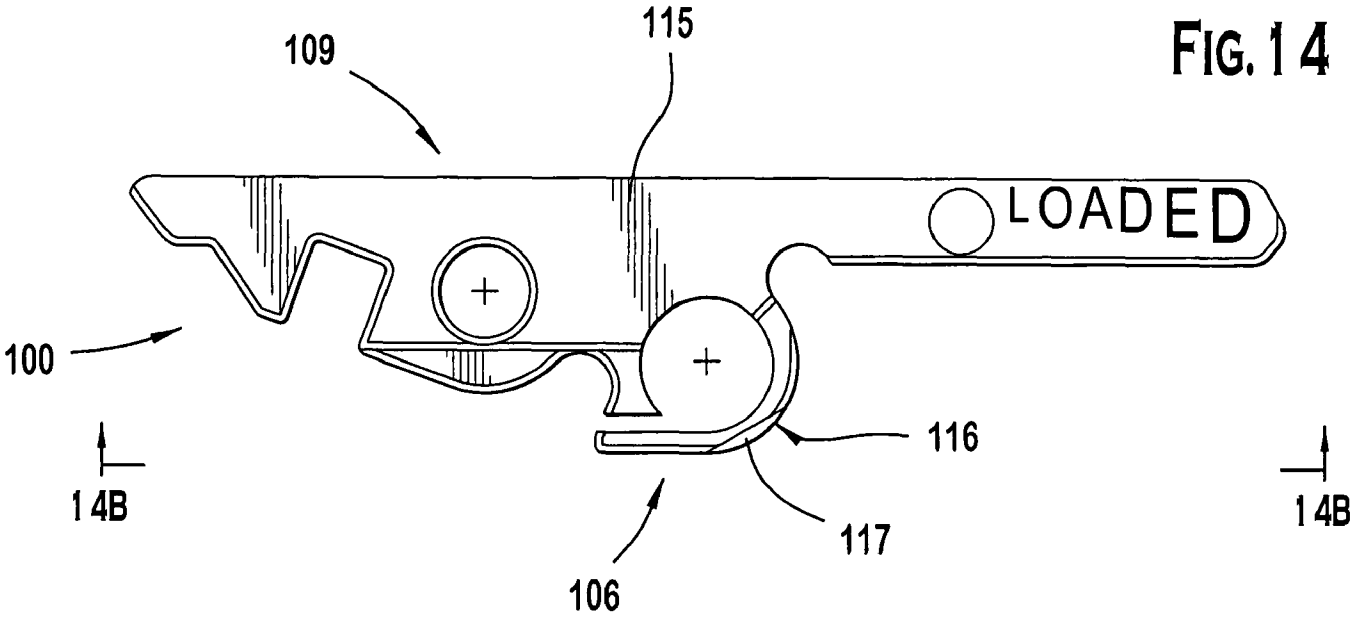
FIG. 14 is a bottom view of the indicating element of FIG. 13.
Figure 14B:
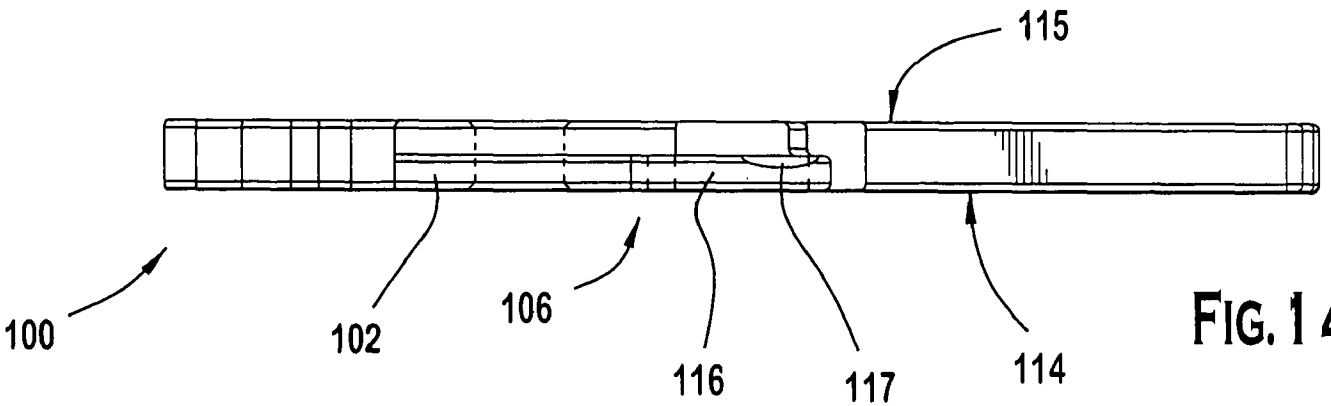
FIG. 14B is a rear elevational view of the indicating element of FIG. 13 taken along line 14B-14B in FIG. 14 and showing the indicating element in an upside-down position.

Referring now also to FIGS. 10-12, pistol 1 further includes a bolt 7 which may be slidably mounted in barrel-receiver assembly 3. Bolt 7 preferably slides in a forward and axial direction towards the front of pistol 1 to push and load a cartridge 50 into chamber 11 from the magazine (not shown). Bolt 7 also preferably slides and is retractable in a rearward axial direction to recoil upon discharging the pistol. This rearward motion allows a spent cartridge casing 52 to be ejected, and a new cartridge to be positioned in receiver 4 for loading forward into chamber 11. Bolt 7 further includes a forward bolt stop surface 47 and breech face 90 which contacts the rear or base 58 of cartridge 50 when it is loaded into chamber 11 by bolt 7. Bolt stop surface 47 abuttingly contacts rear surface 72 of chamber block 70 when cartridge 50 is loaded into chamber 11. Preferably, breech face 90 is recessed below bolt stop surface 47 (see, e.g., FIGS. 3B and 11), thereby defining a space to accommodate base 58 and rim 54 of cartridge 50 when bolt stop surface 75 abuts rear surface 72 as shown in FIG. 3B. Preferably, the depth that breech face 90 is recessed is sufficient to provide extra clearance 91 beyond that necessary to accommodate the actual size and depth of cartridge rim 54. The extra clearance 91 ensures that cartridge rim 54 is not compressed when cartridge 50 is loaded into chamber 11 to avoid discharging pistol 1. Upon firing, cartridge casing 52 and rim 54 expands into the space between chamber block rear surface 72 and breech face 90.

The rear of bolt 7 may further have ears 40 as shown to allow a user to readily grip and manually retract the bolt.

With further reference to FIGS. 1-3, pistol 1 includes a moveable indicating element 10 which identifies and communicates the presence of a fully-loaded cartridge 50 in chamber 11 (i.e., a "loaded chamber") to a user of the pistol. Preferably, indicating element 10 provides a visual and tactile indication or signal to the user of a loaded chamber condition, as further described below. In one embodiment, indicating element 10 may be pivotally mounted in the barrel-receiver assembly 3 about a pivot point P, and preferably in the general proximity of chamber 11, as shown.

As shown in FIGS. 1-3, at least a portion of indicating element 10 may be mounted inside the barrel-receiver assembly 3 such that indicating element 10 is substantially contained within the barrel-receiver assembly 3. In the preferred embodiment shown, indicating element 10 may be positioned and mounted to the side or laterally of chamber 11. Preferably, indicating element 10 is positioned to be contacted by cartridge 50, and more preferably contacted by the side 56 of cartridge rim 54.

It will be appreciated that other mounting positions of indicating element 10 are possible so long as indicating element 10 is mounted close enough to chamber 11 such that at least a portion of indicating element 10 may come into operable contact with and be displaceable by cartridge 50 when the cartridge is loaded in the chamber.

Additional reference is now made to FIGS. 4-6 which shows a preferred embodiment of indicating element 10 in greater detail. Alternatively, it will be appreciated that other suitable embodiments and configurations of an indicating element 10 are possible so long as the indicator is displaceable to a loaded chamber position by contact with the cartridge, and more preferably the cartridge rim 54. Accordingly, the invention is not limited by the preferred embodiment described herein.

As shown, indicating element 10 may include a substantially planar or flat body portion 25 having an overall width W and overall length L, a top surface 16, a bottom surface 18, and at least two longitudinally-extending sides 24, 34 connecting the top and bottom surfaces thereby defining a thickness 21 for indicating element 10. Preferably, side 24 may be substantially flat and faces towards the exterior of pistol 1 in one embodiment. Opposite side 34 may be irregularly-shaped for reasons described below. Indicating element 10 and side 24 are preferably configured as shown such that indicating element 10 will not protrude substantially beyond the exterior of the barrel-receiver assembly 3 when indicating element is in the first position (i.e., cartridge not fully-loaded into chamber 11) described above. It will be appreciated, however, that in some embodiments indicating element 10 may protrude slightly beyond the exterior of barrel-receiver assembly 3. Also preferably, the other side 34 faces towards chamber 11 and is configured to contact cartridge 50 when the cartridge is loaded into the chamber.

Indicating element 10 preferably may be generally elongate in shape and have two ends 12, 14. In one embodiment, indicating element 10 also preferably includes a broadened and laterally projecting portion 26 adjacent to body portion 25. Broadened portion 26 is preferably located between ends 12, 14 approximately near the middle of length L of indicating element 10. In one embodiment, broadened portion 26 may be configured to contact cartridge 50 and may be substantially planar.

In one embodiment, laterally projecting and broadened portion 26 may be flanged such that its thickness 23 is thinner than the thickness 21 of body portion 25 (best seen in FIGS. 5A and 6). This allows the amount material to be removed from bolt 7 to accommodate indicating element 10 to be kept at a minimal so as to not unduly weaken the bolt, for reasons described in more detail below. Also preferably, flanged portion 26 projects from side 34 and in a lateral direction towards chamber 11 when indicating element 10 is mounted in pistol 1.

Preferably, indicating element 10 in one embodiment may be substantially rigid in structure. Preferably, indicating element 10 may made of any type steel; however, other suitable metallic (e.g., aluminum, titanium, etc.) and non-metallic materials (e.g., plastics) that are rigid may be used. In the preferred embodiment, indicating element 10 is made of steel.

With continuing reference to FIGS. 4-6, indicating element 10 may further include a signal area to provide a visual and/or tactile indication of a "loaded chamber" condition to the user of pistol. In one embodiment, the signal area may be configured as an elongated section 27 having an ornamental shape as shown. Elongated section 27 may be attached to or integral with body portion 25 of indicating element 10. At least a portion of elongated section 27 preferably may be capable of protruding outwards beyond the exterior surface 80 of barrel-receiver assembly 3 to provide a tactile and visual signal of a loaded chamber condition to a user of pistol 1. Elongate section 27 may further include an indicia 22 on one or more of its top surface 6, bottom surface 18, or sides 24, 34. In the drawings, indicia are only shown on top surface 6 to avoid unduly cluttering and clearly show the details indicating element 10. However, emplacement of indicia is not limited to top surface 6 alone. The indicia 22 may be in the form of a color, symbolic graphic, marking, alphanumeric characters (in any language), and/or other suitable indicia or combination thereof to communicate and denote that a cartridge 50 is loaded in chamber 11. The indicia may be incorporated onto and/or into the surface by any suitable method commonly used in the art such as painting, etching, inscribing, etc. or any combination thereof. In one embodiment, elongated section 27 is sized sufficiently large enough to include at least one surface area on which at least one alphanumeric character may be placed that is at least about 0.075 inches tall in height 92 (see FIG. 4). In an alternative embodiment, elongate section 27 may be plain without any indicia place thereon.

Indicating element 10 may further preferably include a sensor surface such as cartridge contact surface 28 which is configured and located on element 10 to physically and operably contact cartridge 50 when loaded into chamber 11. Preferably, cartridge contact sensor surface 28 is located on indicating element 10 such that it may be operably contacted by side 56 of cartridge rim 54. Contact sensor surface 28 may be located on broadened portion 26 of indicating element 10. In one embodiment, contact surface 28 may be a cam having a generally arcuate or curved shape to come into gradual and smooth engagement with cartridge rim 54 when loaded into chamber 11; however, other suitable shapes may be used and are contemplated so long as cartridge 50 is able to physically deflect indicating element 10 by contact. Contact surface 28 may also include a chamfer 77 on its underside (see, e.g., FIG. 5A) to further enhance smooth engagement of indicating element 10 with cartridge rim 54.

Preferably, contact surface 28 is an integral part of indicating element 10 and more preferably of portion 26. However, contact surface 28 may be a separate component connected to indicating element 10. In an embodiment of an indicating element 10 having a flanged portion 26 as described above, cartridge contact surface 28 may preferably be disposed on flanged portion 26. The functioning of contact surface 28 will be discussed below.

As best shown in FIGS. 2 and 3 (and noted above), indicating element 10 may be pivotally mounted in barrel-receiver assembly 3 and moveable in preferably a substantially arcuate manner around a pivot point, as will now be described. Indicating element 10 preferably may be located in barrel-receiver assembly 3 so as to be moveable in a lateral direction (as indicated by directional arrow 60) generally perpendicular to the longitudinal axis LA of pistol 1 in the direction of the transverse axis TA. In one embodiment, indicating element 10 may be mounted in barrel-receiver assembly 3 via a moveable pinned arrangement between indicating element 10 and barrel-receiver assembly 3. In one embodiment, indicating element 10 may therefore have a hole 20 configured to receive a pin 29 (shown for example in FIGS. 1-3). Barrel-receiver assembly 3 is provided with a pin cavity 32 (best seen in FIG. 7) that is configured to receive pin 29. The location of hole 20 through which pin 29 passes defines a pivot point "P" for indicating element 10 (see, e.g., FIGS. 2A and 3A). It should be noted that pin 29 is preferably a separate component insertable through into hole 20 as described above. Alternatively, pin 29 may be part of indicating element 10 formed as an integral part thereof or rigidly attached via shrink fitting, welding, threadable attachment, or other suitable method commonly employed in the art. In one embodiment, pin 29 is held in pin cavity 32 by being trapped in the cavity by grip frame 6 when pistol 1 is assembled.

A biasing member may be provided which is in operable relationship with loaded chamber indicating element 10. In one embodiment, the biasing member is a helical spring 38 as shown. Spring 38 may be disposed in the barrel-receiver assembly 3 and interacts with indicating element 10 to preferably bias the indicating element towards the first position described above and shown in FIG. 2 (i.e., absence of a fully-loaded cartridge in the chamber). In one embodiment, indicating element 10 may have a notch 31 (best seen in FIG. 4) to engage and confine spring 38 in position. Spring 38 may be trapped in position within notch 31 and the barrel-receiver assembly 3 when pistol 1 is assembled. Although a biasing member in the form of spring 38 is disclosed, it should be noted that any suitable type of biasing member may be used so long as indicating element 10 may be biased towards the first position.

Operation of the loaded chamber indicator mechanism in conjunction with loading a cartridge into the chamber of a pistol will now be described with reference to the preferred embodiment described herein. FIG. 2 shows cartridge 50, which in this embodiment without limitation is a rimfire cartridge, partially loaded into chamber 11 with the assistance of bolt 7 which is biased forwards by a recoil spring (not shown). In FIG. 2, indicating element 10 preferably does not contact or may slightly contact the side of the cartridge casing 52 provided element 10 does not physically impede the proper loading of cartridge 50 into chamber 11. Indicating element 10 is in the first and non-activated position corresponding to the absence of a cartridge 50 fully-loaded in chamber 11 (i.e., the unloaded-chamber-indication position). In this position, elongated section 27 of indicating element 10 is preferably substantially flush with or recessed with respect to the exterior surface 80 of barrel-receiver assembly 3 such that indicating element 10 does not substantially physically protrude outwards from pistol 1. The first position therefore signifies an unloaded chamber condition.

As cartridge 50 continues to be loaded forward into chamber 11 by bolt 7, the side 56 of rim 54 eventually contacts and engages indicating element 10, preferably at cartridge contact sensor surface 28 of side 34 of indicating element 10. Rim 54 activates and physically displaces indicating element 10, causing indicating element 10 to pivotally move about pivot point P. Indicating element 10 comes to a second and fully-activated position as shown in FIG. 3, wherein cartridge 50 is fully-loaded into chamber 11, and the side 56 of cartridge rim 54 holds indicating element 10 in a fully-extended position (i.e., the loaded-chamber-indication position). As shown, elongated section 27 of indicating element 10 preferably protrudes beyond the exterior surface 80 of barrel-receiver assembly 3 to indicate that a cartridge is fully-loaded in chamber 11. In this position, elongated section 27 may be clearly seen and felt by a user of pistol 1 to provide a visual and tactile indication of a loaded chamber condition. Accordingly, the change in position of indicating element 10 from the first inactivated position to the activated second position is used to identify and communicate the presence of a fully-loaded chamber to the pistol user. The second position therefore signifies a loaded chamber condition.

Pistol 1 is normally discharged when trigger 8 is pulled, thereby causing firing pin 36 to strike the rear of cartridge rim 54. As shown in the figures (particularly FIG. 3B), a portion of rim 54 rests outside of and overlaps the rear of chamber 11, thereby allowing firing pin 36 to crush the rim against the rear of chamber 11 to ignite the primer material, and discharge pistol 1. The spent cartridge casing 52 is then ejected from pistol 1. Without cartridge 50 in chamber 11, spring 38 returns indicating element 10 to the initial first or non-activated position described above. As another cartridge 50 is loaded into chamber 11 either automatically via the magazine or manually, the above sequence is repeated and indicating element 11 moves to the second fully-activated position to indicate that the pistol is loaded.

It should be noted that pin 29, and thus pivot point P, may be located in a number of suitable positions along the length L (see FIG. 5) of indicating element 10. Preferably, in one embodiment as shown in FIG. 4, pivot point P is asymmetrically located along the length L of indicating element 10 being positioned closer towards the forward end 12 of indicating element 10 than towards the rear end 14, and preferably near and forward of sensor contact surface 28. Accordingly, the distance between pivot point P and forward end 12 is shorter than the distance between pivot point P and rear end 14. Also preferably, the end 14 of elongate section 27 (i.e., the signal area) may be located relatively far from pivot point P. This advantageous arrangement physically magnifies the lateral displacement of elongated section 27 (i.e., in a direction along the transverse axis TA) when indicating element 10 is activated by contact with cartridge rim 54, making the signal area visually and tactilely noticeable to a pistol user than known loaded chamber indicators. Thus in a preferred embodiment, the signal area of indicating element 10 is located farther from pivot point P than sensor contact surface 28 of indicating element 10. It will be appreciated, however, that numerous variations and configurations of indicating element 10 and accompanying positioning of sensor contact surface 28 and signal area 27 are possible and contemplated within the scope of the claims appended hereto.

Figure 8:
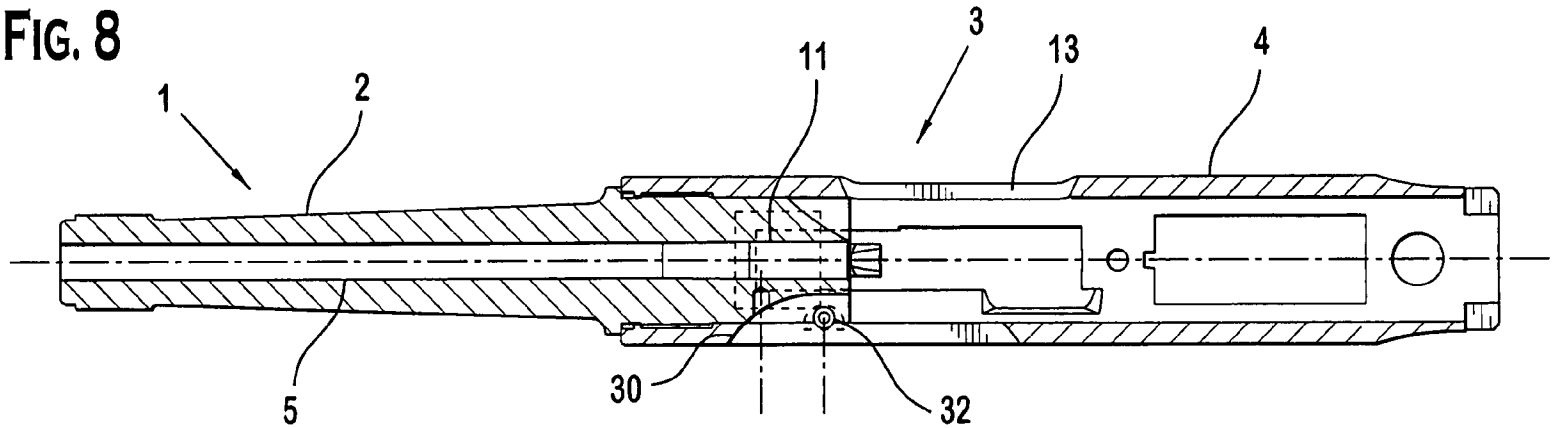
FIG. 8 is a top cross-sectional view of the barrel-receiver assembly taken along line 8-8 in FIG. 7.
Figure 9:
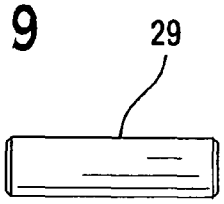
FIG. 9 shows the pivot pin of FIG. 1 used to mount the indicating element in the pistol of FIG. 1.

To accommodate and receive indicating element 10, the barrel-receiver assembly 3 preferably includes a cutout 30 (best seen in FIGS. 7 and 8). Preferably, cutout 30 allows indicating element to be housed inside pistol 1 when a cartridge 50 is not loaded in chamber 11. Accordingly, in one embodiment, cutout 30 is sized and configured cooperatively with the size and configuration of indicating element 10. Preferably, cutout 30 in the embodiment shown has at least one curved or arcuate surface to match the embodiment of indicating element 10 (as shown in FIG. 4). Cutout 30 preferably may be designed to communicate with the area to the rear of chamber 11 to allow indicating element 10 to be contacted and activated by rim 54 of cartridge 50. Cutout 30 also preferably communicates with the exterior of pistol 1 such that indicating element 10 may protrude outwards from barrel-receiver assembly 3 to visually and tactilely indicate a loaded chamber condition.

As shown in FIGS. 10-12, and functionally similar to cutout 30 in barrel-receiver assembly 3 described above, bolt 7 also preferably includes a cutout or recess 42 to receive indicating element 10. Bolt recess 42 may preferably configured to accommodate indicating element 10 when bolt 7 slidably moves forwards and rearwards in barrel-receiver assembly 3 to avoid physical interference with the operation of these components.

Bolt recess 42 includes an upper cavity 41, lower cavity 43, and a step 45 between upper and lower cavities 41, 43. Preferably, step 45 may be inclined or ramped as shown. In one embodiment as shown, lower cavity 43 and upper cavity 45 are preferably contiguous and form a common space to accommodate indicating element 10. Also as shown, upper cavity 41 preferably is deeper extending farther radially inwards towards the center of bolt 7 than lower cavity 43. Accordingly, in a preferred embodiment, the volume of upper cavity 41 is larger than that of lower cavity 43.

The forward or bolt stop surface 47 of bolt 7 (typically made of steel) preferably may be surface work hardened during the manufacturing process. This toughens bolt stop surface 47 to withstand forces imparted by bolt 7 striking the rear surface 72 of chamber block 70, thereby minimizing the possibility of structural fractures. Interior portions of bolt 7, however, are not hardened and less resistant to such impact forces. Accordingly, bolt recess 42 preferably may be stepped in shape as shown to minimize the amount of undercutting required and concomitantly maximize the strength of bolt 7. Thus, indicating element 10 is preferably cooperatively shaped with bolt recess 42 and in the preferred embodiment may have a stepped configuration also (as best shown in FIG. 6).

FIGS. 13-17A show one embodiment of a one-piece energy-absorbing loaded chamber indicating element 100 which is flexible and resistant to lateral or side impacts to the indicating element when the signal area or portion is protruded from the firearm (as in a loaded chamber condition). The one-piece energy-absorbing indicating element 100 may be generally sized, configured, functions, and contains indicia similarly to the indicating element described above and shown in FIGS. 4-6. Indicating element 100 includes a body portion 109, two sides 101, 102, two ends 103, 104, a top surface 114 and a bottom surface 115. Indicating element 100 pivotally mounts to barrel-receiver assembly 3 via hole 105 which receives pin 29 therethrough. Indicating element 100 further includes a sensor portion 106 for contacting the cartridge rim 54 and a signal portion 107 for indicating the presence of a loaded chamber condition. Signal portion 107 may be connected to body portion 108 via a transition section 119 having a semi-circular notch 108 which adds flexibility to the signal portion, thereby allowing the signal portion to also deflect or deform at least partially when struck by a lateral blow. Sensor portion 106 may include a cartridge contact sensor surface 116 in the form of a cam, which optionally may further include a chamfer 117 in one embodiment, to facilitate smooth engagement of the indicating element 100 with the cartridge rim 54.

Sensor portion 106 includes a cantilevered spring arm 110, which may be formed by cutout 111 in the sensor portion. Preferably, sensor contact surface 116 is located on spring arm 110 which may have an arcuate shape formed by cutout 111 having a generally circular shape. Spring arm 110 preferably is sized and configured such that it does not deflect or deform when contacted and displaced laterally by rim 54 of cartridge 50 to indicate that a cartridge is loaded into chamber 11. Also preferably, spring arm 110 is sized and configured, however, to deflect when a greater external lateral load or force is applied to the signal portion 107 than the smaller force exerted on the spring arm by contact with the cartridge 50. Based on the mechanical properties of the material used to fabricate indicating element 100, determination of the required cross-sectional shape and size of spring arm 110 to achieve the foregoing functionality is readily well within the purview of those skilled in the art. A gap 113 is provided between spring arm 110 and a lateral protrusion 112 extending outwardly from body portion 109 of indicating element 100. Gap 113 allows movement of spring arm 110 when the spring arm is deflected.

Spring arm 110 of indicating element 100 is movable from a first undeflected position to a second deflected position occurring when a predetermined external load or force is applied to the lateral side of signal portion 107. Gap 113 narrows when spring arm 110 moves from the first to second position.

Figure 15:
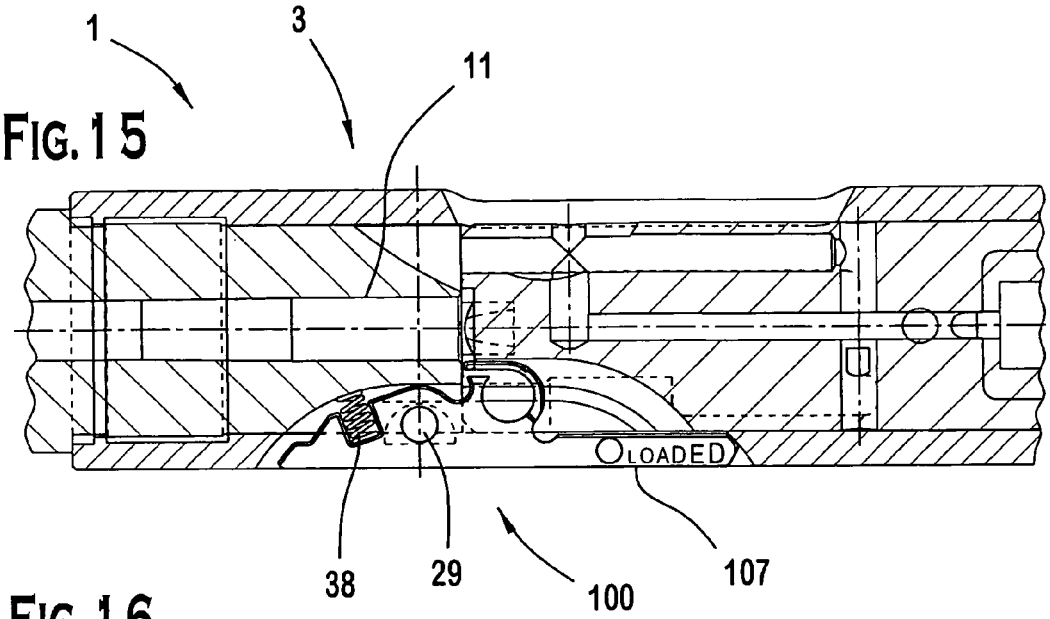
FIGS. 15-17 are partial top cross-sectional views of the pistol of FIG. 1 showing the indicating element of FIG. 13 in various positions including, respectively, without a cartridge present, with a cartridge present, and with a cartridge present and an external lateral force applied to the indicating element.
Figure 16:
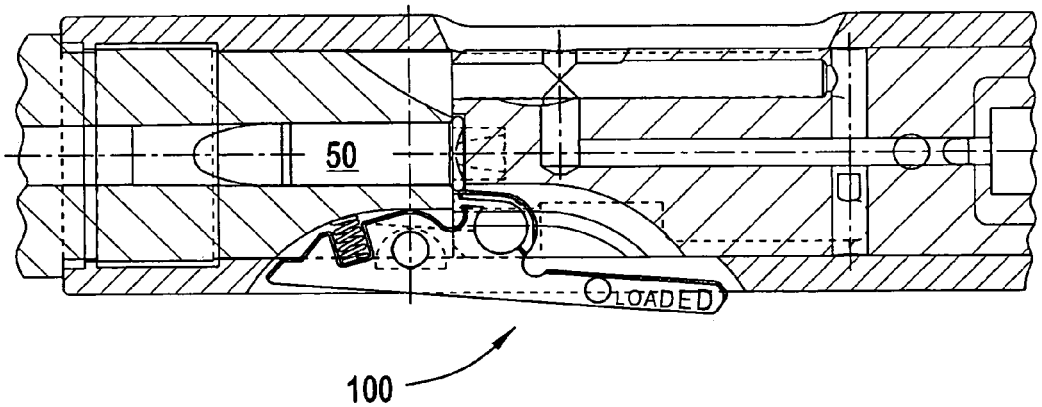
Figure 17:
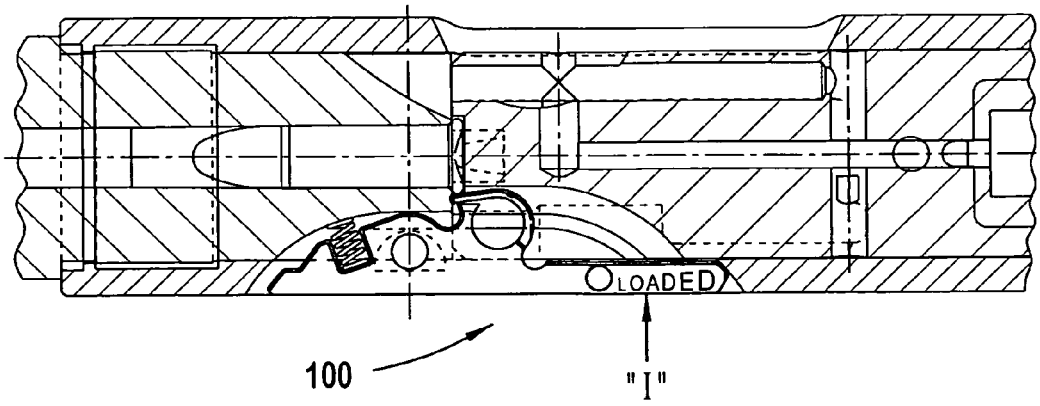

The operation of indicating element 100 will now be described with additional reference to FIGS. 15-17A. FIGS. 15, 16, and 17 show indicating element 100 pivotally mounted in the barrel-receiver assembly 3 and in various positions related to the presence or absence of both a cartridge in the chamber and an external lateral load applied to the side of the indicating element. Corresponding FIGS. 15A, 16A, and 17A show indicating element 100 in those same positions, but disembodied from the barrel-receiver assembly to more clearly illustrate the relationship between the relevant components.

It should be noted that indicating element 100 operates in the same manner as indicating element 10 described above with regards to sensing and indicating the presence of a cartridge in the chamber (i.e., a loaded-chamber condition). Accordingly, reference is made to the discussion above which is not be repeated here for the sake of brevity, and only the energy-absorbing functionality of indicating element 100 will now be described.

Figure 15A:
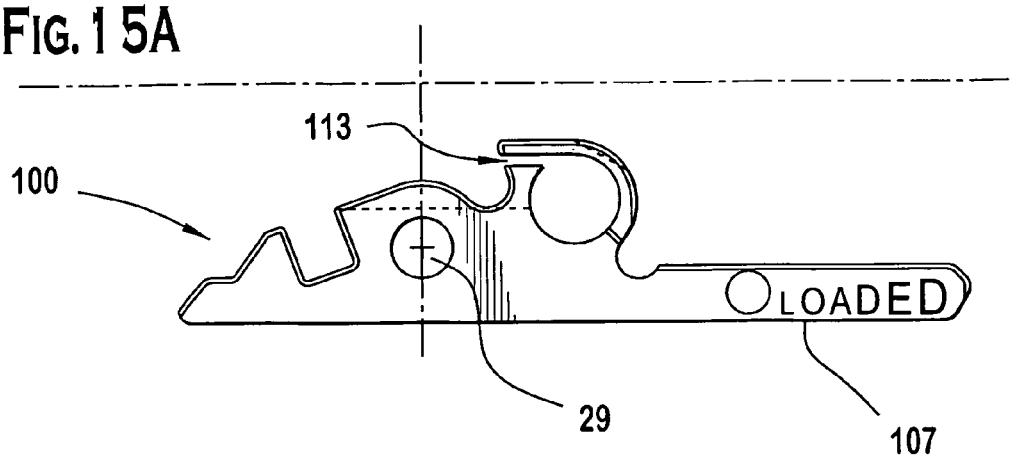

In FIGS. 15 and 15A, indicating element 100 is shown in its first inactivated position corresponding to an empty chamber 11 condition. Signal portion 107 remains inside the barrel-receiver assembly 3 of pistol 1. Spring arm 110 is in its first undeflected position. A biasing member such as spring 38 biases indicating element 100 inwards towards chamber 11 and ultimately into engagement with a cartridge when present. Notch 118 (see FIG. 13) helps retain spring 38 in position when indicating element 100 is mounted in pistol 1.

Figure 16A:
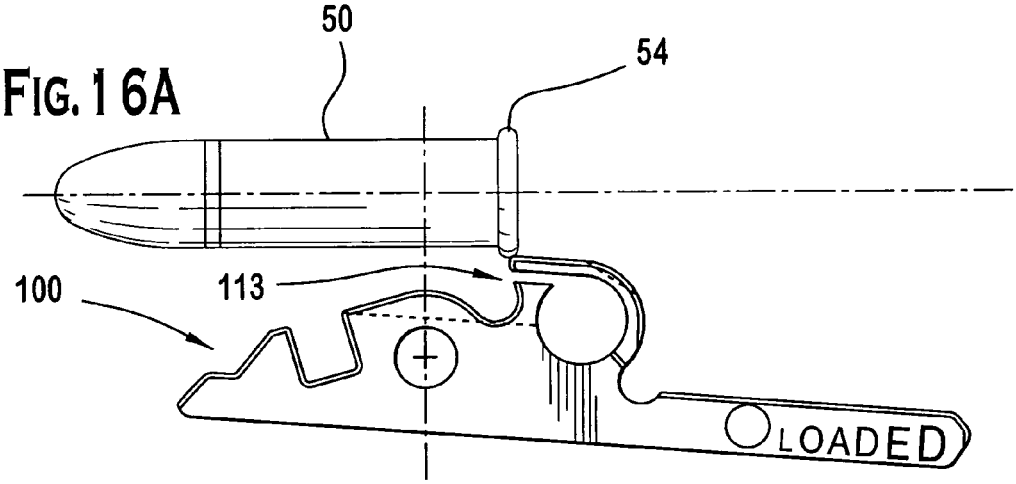
Figure 17A:
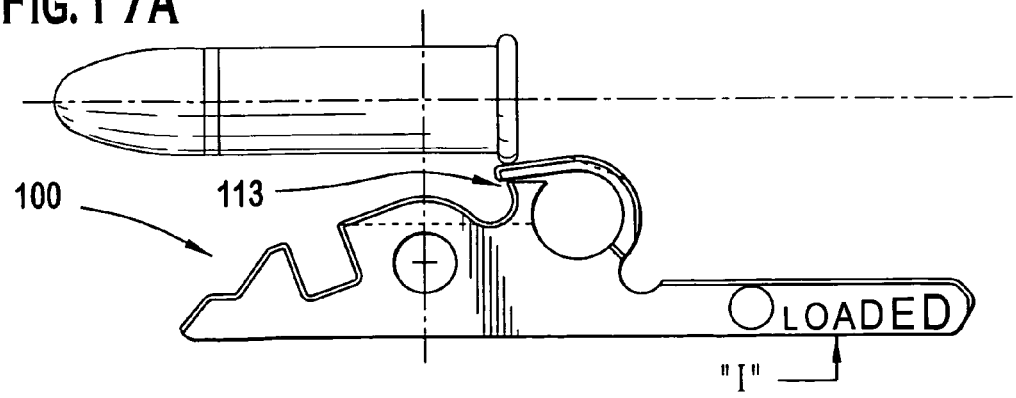

In FIGS. 16 and 16A, a cartridge 50 has been loaded into chamber 11 and indicating element 100 has been moved into its second activated position having been laterally displaced by contact with the cartridge rim 54. Signal portion 107 now protrudes outwards from the exterior of barrel-receiver assembly 3 to visually and tactilely communicate the presence of a loaded chamber condition. Spring arm 110, however, remains in its first and undeflected position.

FIGS. 17 and 17A basically show the same position of indicating element 100 in relation to barrel-receiver assembly 3 as shown in FIGS. 16 and 16A, with a cartridge 50 loaded in chamber 11. To simulate striking the protruded signal portion 107 of indicating element 100 from the side, however, an external lateral impact force represented by directional arrow "I" is shown. Due to the functioning of spring arm 110, the impact energy from the lateral blow is dissipated by movement of the spring arm from its undeflected position to its deflected position shown in FIGS. 17 and 17A. Concomitantly, gap 113 narrows (compare FIG. 16 with FIG. 17). Therefore, the force or energy of the lateral impact on indicating element 100 is at least partially absorbed by and stored in the deflection of spring arm 110.

When the external force "I" is removed from signal portion 107 of indicating element 100, the energy stored in spring arm 110 is released causing the resilient spring arm to return to its original undeflected position shown in FIGS. 16 and 16A.

Another embodiment of an energy-absorbing indicating element in the form of a collapsible two-piece indicating element 130 is shown in FIGS. 18-23A. In the preferred embodiment, indicating element 130 may be spring-loaded and collapsible being movable from an expanded position to a collapsed position, as will be further described below. The two-piece indicating element design eliminates lateral loads on the rim 54 of cartridge 50 that may caused by lateral or side impacts to a protruding indicating element, as discussed herein.

Figure 21:
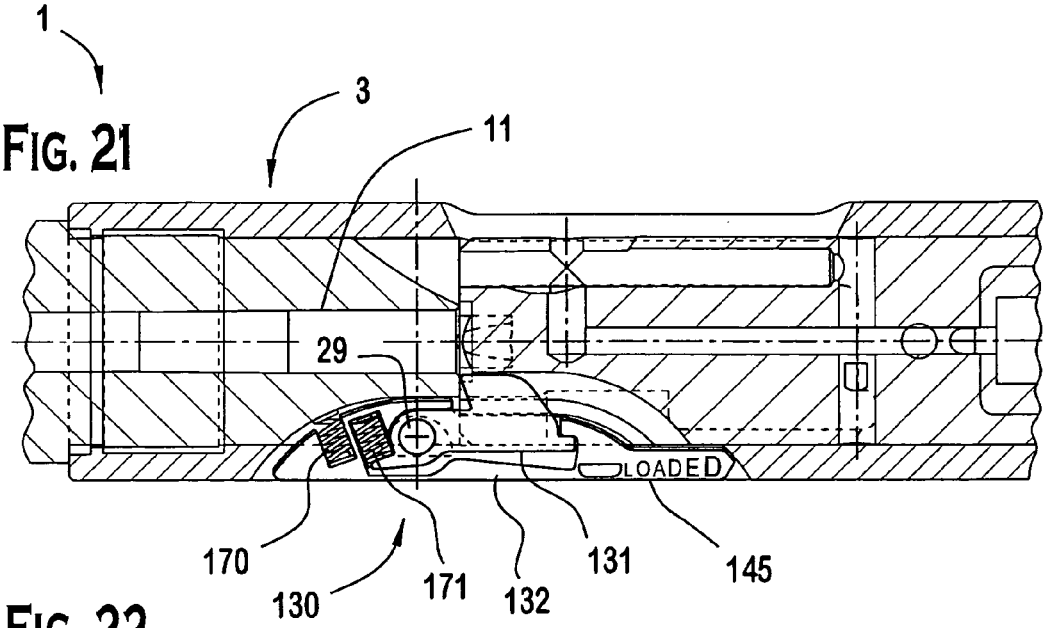
FIGS. 21-23 are partial top cross-sectional views of the pistol of FIG. 1 showing a third embodiment of an indicating element of FIG. 13 incorporating the signal member of FIG. 18 and sensing member of FIG. 20, with the third embodiment in various positions including, respectively, without a cartridge present, with a cartridge present, and with a cartridge present and an external lateral force applied to the indicating element.
Figure 21A:
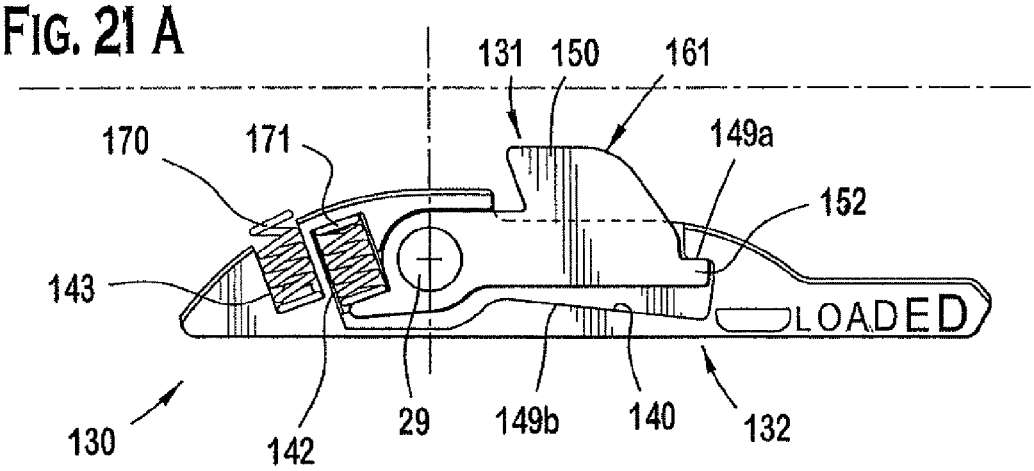

With initial reference to FIG. 21A, a two-piece indicating element generally includes a sensing member 131 for sensing the presence of a cartridge 50 in chamber 11 and a signal member 132 for communicating the presence of a loaded chamber condition to a pistol user. Preferably, as in the embodiment shown, sensing member 131 and signal member 132 are movable and displaceable in relation to one another which will be more fully described below. In one embodiment, indicating element 130 may further include at least one biasing member, and more preferably at least two biasing members such as springs 170 and 171, as shown for example in FIG. 21. In the preferred embodiment, springs 170 and 171 are helical-type springs; however, any suitable type of spring may be used so long as the required biasing functionality described below is provided.

Sensing member 131 and signal member 132 will be further described separately first to facilitate discussion of their combined function in indicating element 130 which will follow.

Figures 18, 18A, 18B, 18C:
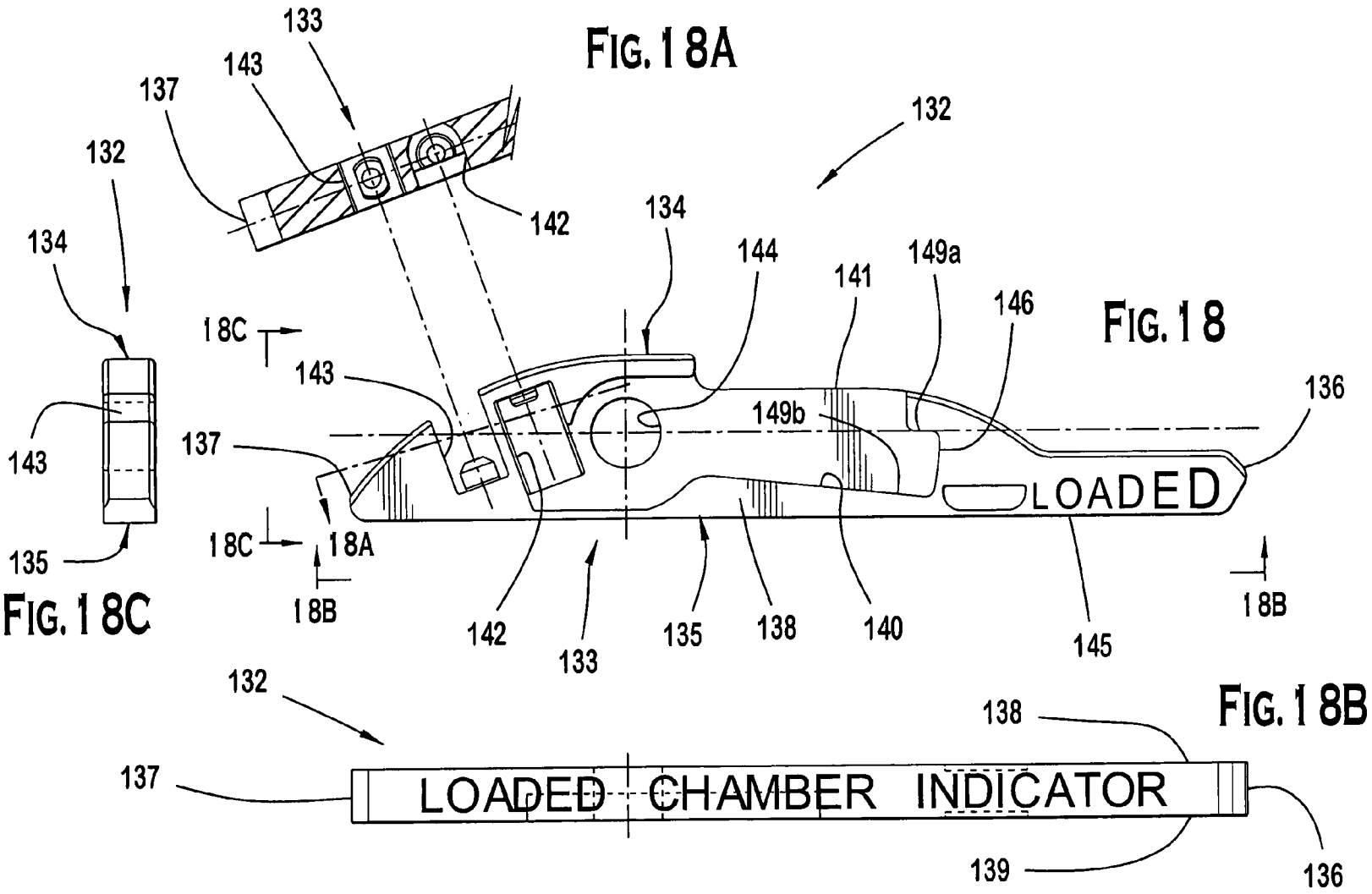
FIG. 18 is a top view of a signal member of a third embodiment of an indicating element useable in the pistol of FIG. 1.
FIG. 18A is partial cross-sectional view of the signal member of FIG. 18 taken along line 18A-18A of FIG. 18.
FIG. 18B is a front elevational view of the signal member of FIG. 18 taken along line 18B-18B of FIG. 18.
FIG. 18C is a side elevational view of the signal member of FIG. 18 taken along line 18C-18C of FIG. 18.
Figures 19, 19A:
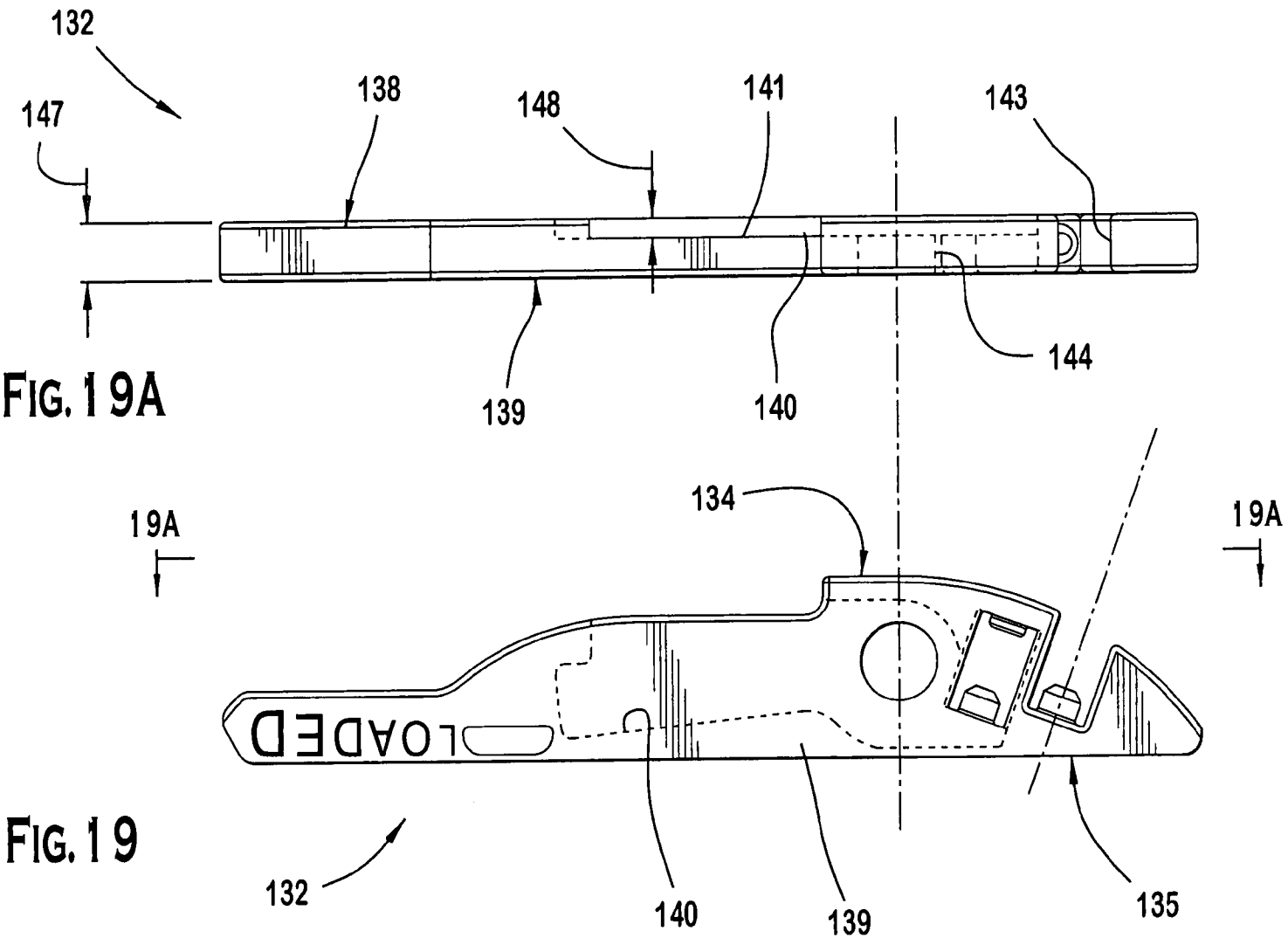
FIG. 19 is a bottom view of the signal member of FIG. 18.
FIG. 19A is a rear elevational view of the signal member of FIG. 18 taken from line 19A-19A of FIG. 19 and showing the signal member in an upright position.

Referring to FIGS. 18-19A, signal member 132 includes a body portion 133, two sides 134, 135, two ends 136, 137, a top surface 138, a bottom surface 139, and a thickness 147 defined between the top and bottom surfaces. A hole 144 may be provided for pivotally mounting the signal member 132 to the barrel-receiver assembly 3 via a pin 29 (see FIGS. 21 and 21A). Signal member 132 includes a signal portion or area 145 which is configured and sized to protrude outwards beyond the exterior of barrel-receiver assembly 3 of pistol 1 to visually and tactilely communicate the presence of a loaded chamber condition to the pistol user.

In one embodiment, signal member 132 may define a cavity 140 formed by recessing a portion of top surface 138. Alternatively, cavity 140 may be recessed in the bottom surface 139 of indicating element 130. Cavity 140 may include an upper vertical wall 149*a* and a lower vertical wall 149*b*. Cavity 140 is configured and sized to receive and hold at least a part of sensor member 131 (as best shown in FIGS. 21A-23A) so that the total combined thickness of signal member 132 and sensing member 131 when assembled may be minimized, thereby resulting in a compact configuration. In one embodiment, cavity 140 has a depth 148 of at least about 0.032 inches, sensing member 131 has a thickness of at least about 0.032 inches (see FIG. 20A), and signal member 132 has a thickness 147 of at least about 0.094 inches. Cavity 140 may further include a cutout 145 to receive tab 152 of sensing member 131 (see FIG. 20). Cutout 145 and tab 152 provides a guide for sensing member 131 and an arcuate travel limit stop for sensing member 131, as will be described more fully below. Cavity 140 may further include a window 141 in side 134 from which sensing portion 150 of sensing member 131 (see FIG. 20) may protrude outwards from signal member 131.

It should be noted that signal member 132 need not be provided with a cavity for signal member 131 in other possible embodiments. Accordingly signal member 132 and sensing member 131 may simply be stacked one on top of each other.

To help retain springs 170 and 171, signal member 132 may include a notch 143 to hold spring 170 and a trough 142 to hold spring 171, as best shown in FIGS. 18 and 18A. One end of spring 170 acts against barrel-receiver assembly 3 while the other end of the spring acts against signal member 132 in notch 143. As shown, one end of spring 171 acts against signal member 132 while the other end of spring 171 acts against projection 151 of sensing member 131. Accordingly, the biasing effect of spring 171 tries to spread the two members apart in a scissors-like fashion about mounting pin 29 (see, e.g., FIGS. 21 and 21A), thereby holding indicating element 131 in expanded position with sensor portion 150 of sensing member 131 displaced at a maximum distance apart from signal portion 145 of signal member 132. Preferably, trough 142 may have a generally semi-circular cross-section to correspond with the shape of helical spring 171.

Figures 20, 20A:
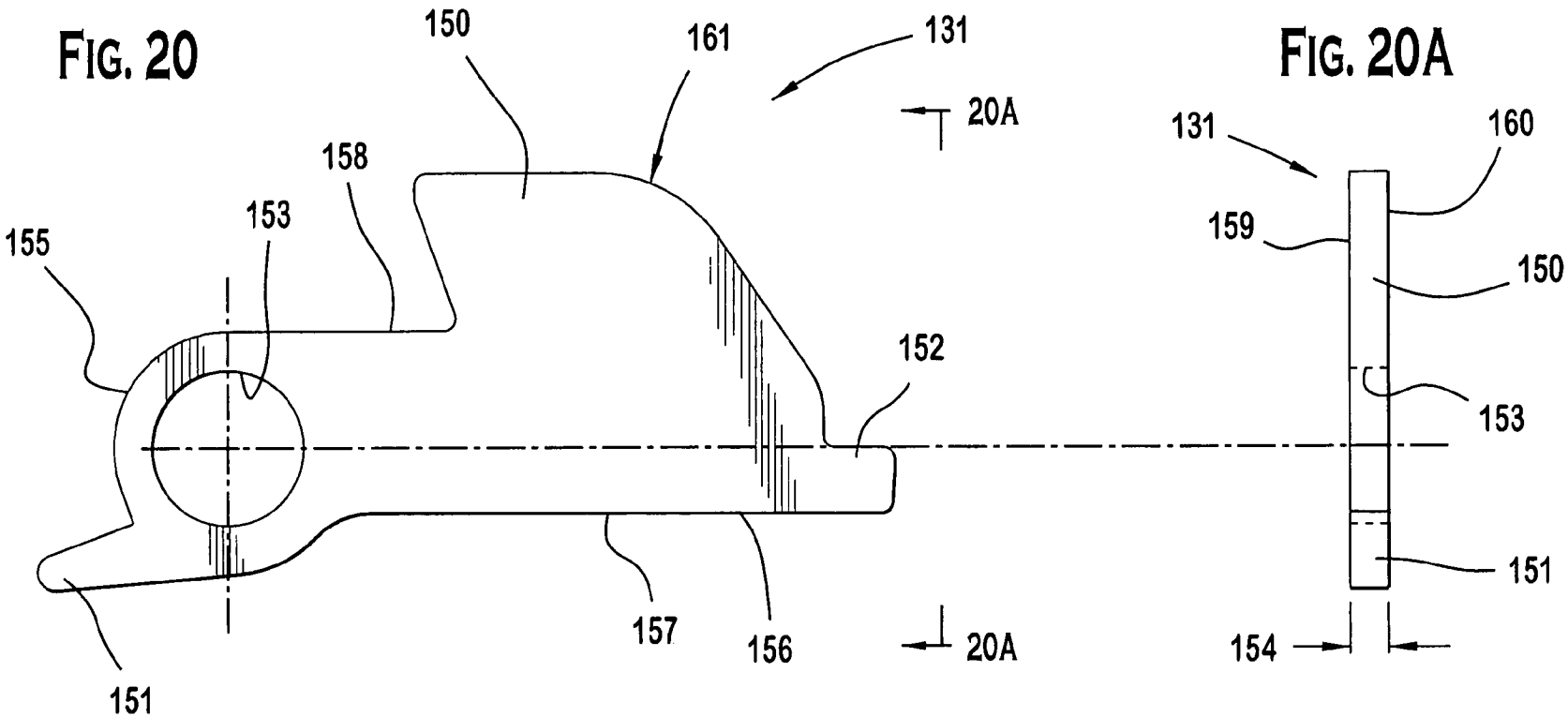
FIG. 20 is a top view of a sensing member of a third embodiment of an indicating element useable in the pistol of FIG. 1.
FIG. 20A is a side elevational view of the sensing member of FIG. 20 taken along line 20A-20A of FIG. 20.

Sensing member 131 is best shown in FIGS. 20 and 20A. In one embodiment, sensing member 131 includes two sides 157, 158, a flange-like sensing portion 150 laterally-extending from side 158, two ends 155, 156, a top surface 159, and a bottom surface 160. Sensing member 131 may be pivotally mounted to barrel-receiver assembly 3 via hole 153 which receives pin 29 therethrough commonly with hole 144 of signal member 132. In one embodiment, as mentioned above, a lobe-like projection 151 laterally-extending from end 155 may be provided to engage one end of spring 171.

Although in the embodiment shown, sensing member 131 and signal member 132 share a common pivotal mount to barrel-receiver assembly 3 via pin 29, it will be appreciated that other suitable mounting arrangements are possible so long as sensing member 131 is movable in relation to signal member 132. For example, sensing member 131 may alternatively be pivotally or axially movable and mounted directly to signal member 132 alone.

Sensor portion 150 may include a preferably cam-shaped sensor surface 161 which facilitates smooth engagement of indicating element 130 with the cartridge rim 54. As noted above, in the embodiment shown sensor portion 150 may protrude outwards from window 141 in signal member 132 (see, e.g., FIG. 21A).

As noted above, a tab 152 laterally-extending from end 156 of sensing member 131 may be provided which in conjunction with cutout 146 of signal member 132 serves as a guide for sensing member 131 and an arcuate travel limit stop to confine the movement or displacement of the sensing member in relation to the signal member 132. This also will be more fully described below.

Figure 22:
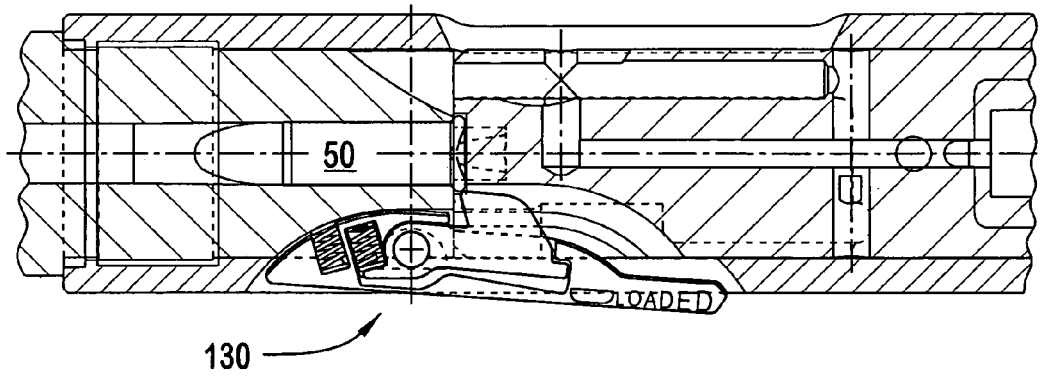
Figure 23:
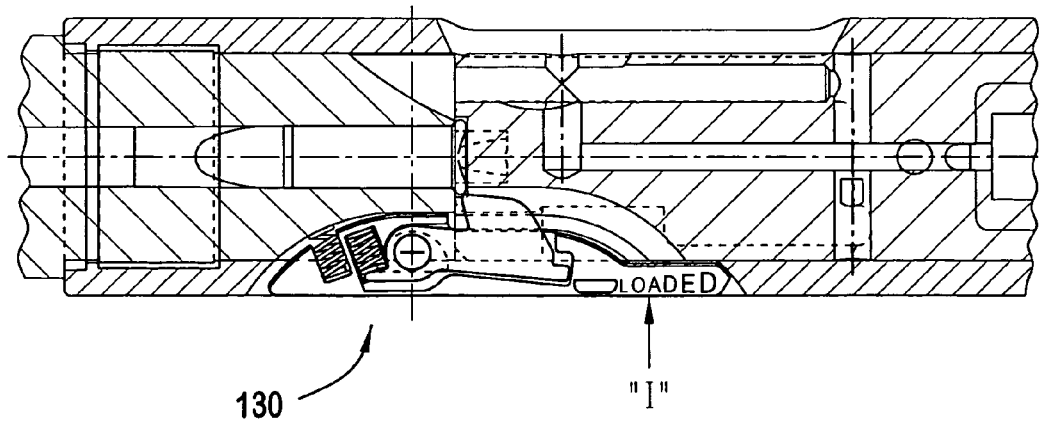

The operation of indicating element 130 will now be described with particular reference to FIGS. 21-23A. FIGS. 21, 22, and 23 show indicating element 130 pivotally mounted in the barrel-receiver assembly 3 and in various positions related to the presence or absence of both a cartridge in the chamber and an external lateral load applied to the side of the indicating element. Corresponding FIGS. 21A, 22A, and 23A show indicating element 130 in those same positions, but disembodied from the barrel-receiver assembly to more clearly illustrate the relationship between the relevant components.

It should be noted that indicating element 130 operates in the same manner as indicating element 10 described above with regards to sensing and indicating the presence of a cartridge in the chamber (i.e., a loaded-chamber condition). Accordingly, reference is made to the discussion above which is not be repeated here for the sake of brevity, and only the energy-absorbing functionality of indicating element 130 will now be described.

In FIGS. 21 and 21A, indicating element 130 is shown in its first inactivated position corresponding to an empty chamber 11 condition. Signal portion 145 of signal member 132 remains inside barrel-receiver assembly 3 of pistol 1. Spring 170 is biasing the sensor portion 150 of sensing member 131 inwards in a counter-clockwise direction towards chamber 11 so that a cartridge 50 may be contacted and sensed if present in the chamber. Indicating element 130 is in an expanded position with spring 171 acting to spread sensor portion 150 of sensing member 131 and signal portion 145 of signal member 132 at a maximum distance apart from each other. Signal member 132 is in its first position in relation to sensing member 131, which position corresponds to the absence of an external lateral force on signal portion 145 of the signal member. In this first position of signal member 132, tab 152 of the sensing member may be abutted as shown against upper wall 149*a* of cavity 140 in the signal member.

Figure 22A:
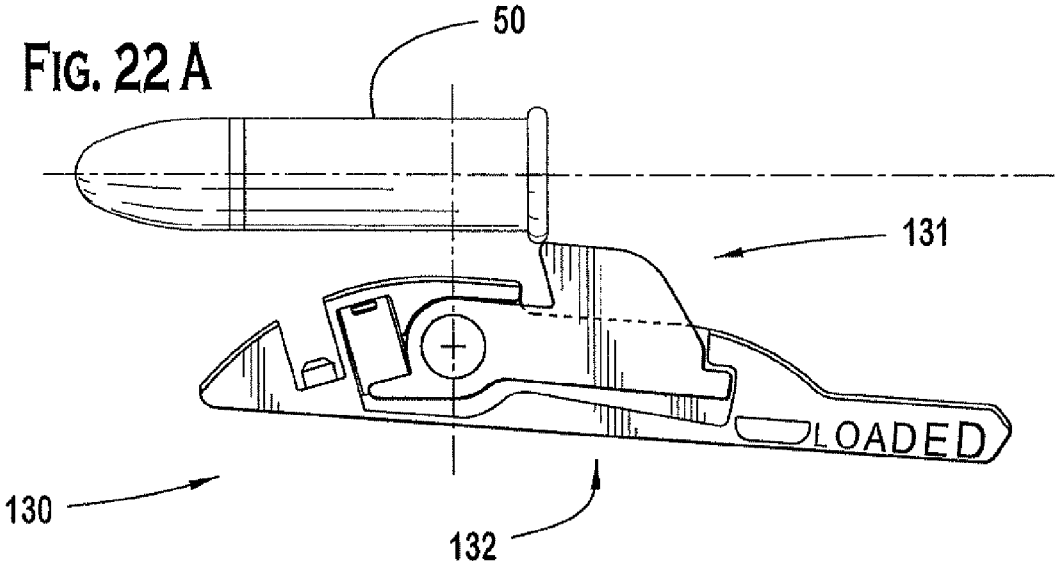
Figure 23A:
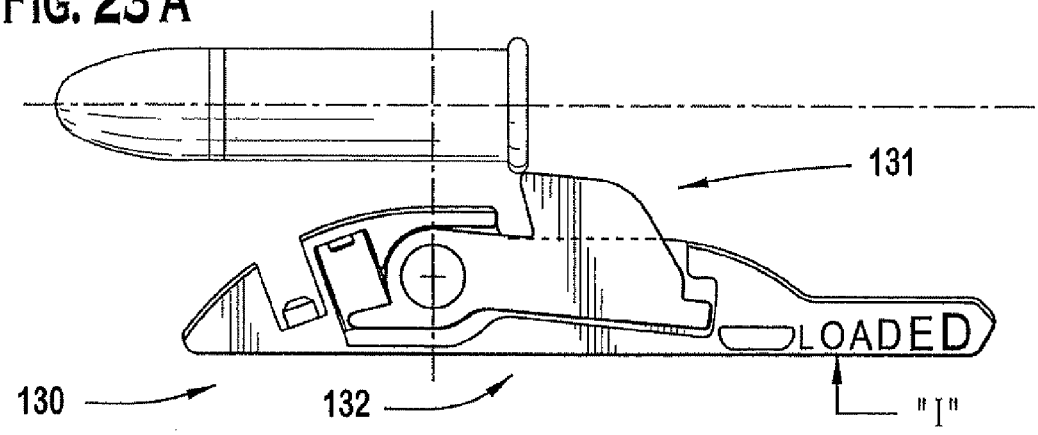

In FIGS. 22 and 22A, a cartridge 50 has been loaded into chamber 11 and indicating element 130 has been moved into its second activated position having been laterally displaced by contact with the cartridge rim 54. Signal portion 145 now protrudes outwards from the exterior of barrel-receiver assembly 3 to visually and tactilely communicate the presence of a loaded chamber condition. Sensing member 131, however, remains in its first position (note that tab 152 remains abutted against upper wall 149*a* of signal member 132).

FIGS. 23 and 23A basically show the same position of indicating element 100 in relation to barrel-receiver assembly 3 as shown in FIGS. 22 and 22A, with a cartridge 50 loaded in chamber 11. To simulate striking the protruded signal portion 145 of indicating element 130 from the side, however, an external lateral impact force represented by directional arrow "I" is shown. Laterally striking indicating element 130 causes signal member 132 to pivot counter-clockwise about pin 29 against the urging of spring 171, thereby concurrently moving signal portion 145 back inside barrel-receiver assembly 3 to its original position shown in FIG. 21. Sensing member 131 remains stationary and in contact with cartridge rim 54, whereas signal member 132 has now moved (in relation to the sensing member) to its second position corresponding to the presence of a lateral force being applied to signal portion 145 of the signal member. This can be seen by noting that tab 152 of sensing member 131 has disengaged vertical cavity wall 149*a* of signal member 132 and moved outwards towards vertical cavity wall 149*b* within cutout 146. Indicating element 130 is now in its collapsed position, with signal portion 145 of signal member 132 being closer in distance to sensor portion 150 of sensing member 131 than shown in the starting position in FIGS. 21 and 21A.

Still referring to FIGS. 23 and 23A, the impact energy from the lateral blow to protruding signal portion 145 of signal member 132 is dissipated by collapsing indicating element 130 and compressing spring 171. Therefore, the force or energy of the lateral impact on indicating element 130 is at least partially absorbed by and stored in the compression of spring 171.

When the external force "I" is removed from signal portion 145 of indicating element 130, the energy stored in spring 171 is released causing the collapsed indicating element to return to its original expanded position and concomitantly moving signal member 132 back to its original first position shown in FIGS. 22 and 22A.

Figure 24:
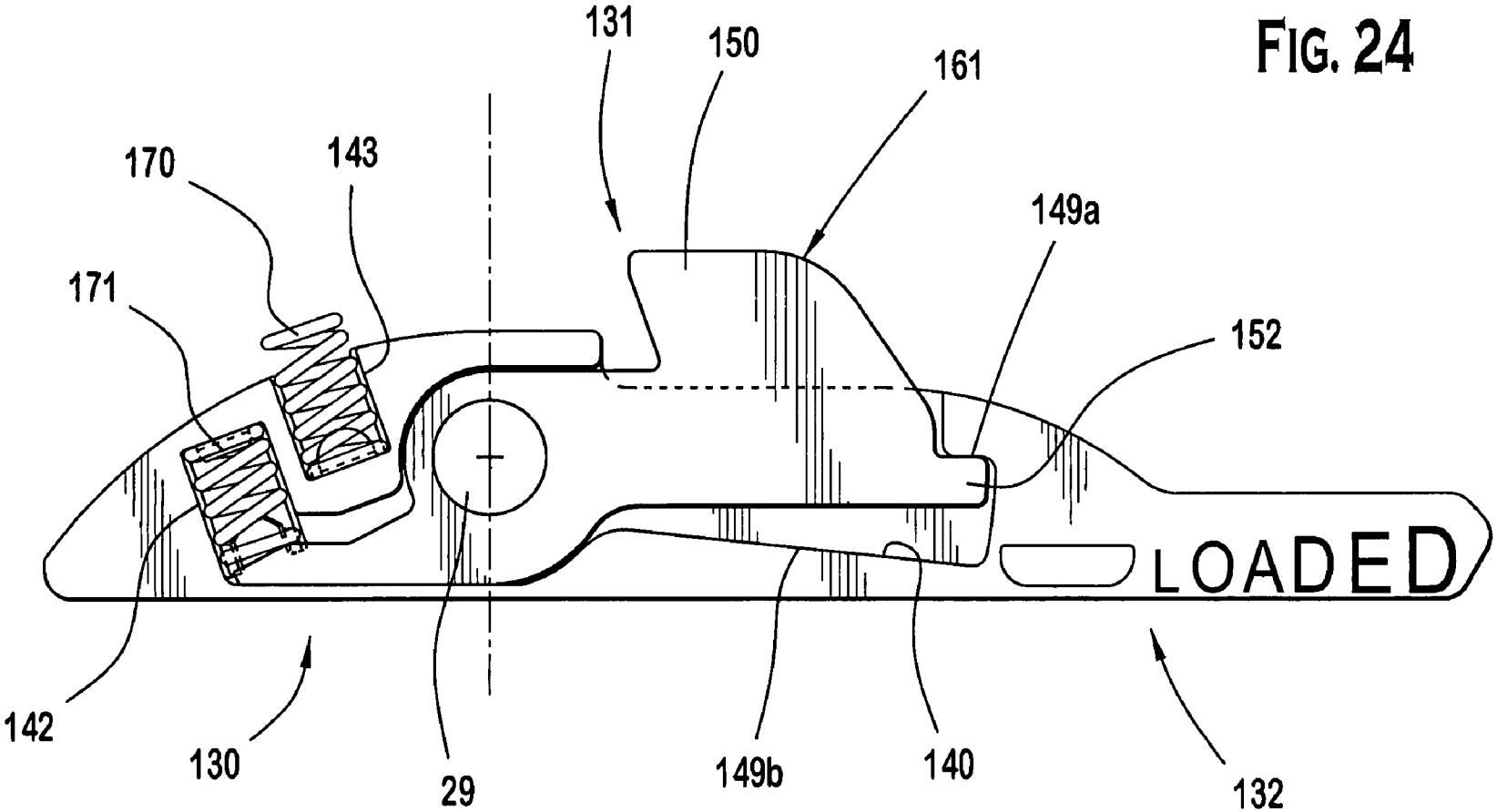
FIG. 24 shows an alternative embodiment of the indicating element of FIG. 20 wherein the spring positions have been switched with respect to the pivot pin.

In one embodiment, spring 170 may be weaker (i.e., have a lower "k" spring force) than spring 171. With this arrangement, it take less force for the cartridge 50 to laterally displace indicating element 130 outwards signaling a loaded chamber condition than it does for an external lateral force to push signal portion 145 of signal member 132 back inwards. Alternatively, springs 170 and 171 may be selected to have the same spring force. In addition, it will be appreciated that varying the distances of springs 170, 171 from the pivot point created by mounting pin 29 will affect the spring force selection required for springs 170, 171. Accordingly, these distances and spring force of springs 170, 171 may be varied so long as the proper functioning of indicating element 130 is maintained. It should also be noted that the positions of springs 170, 171 may be switched, as shown for example in an alternative embodiment depicted in FIG. 24. In FIG. 24, projection 151 has been extended to allow spring 170 (preferably weaker than 171 in one embodiment) to be located closer to pivot pin 29 than spring 171, as shown. Accordingly, the strength of springs 170, 171 and their placement in indicating element 130 may be varied so long as the proper functioning of the indicating element as described above is achieved, and the invention is not limited in this respect.

Sensing member 131 and signal member 132 may be fabricated from any suitable metallic or non-metallic materials. For example, these members may made of any type steel, aluminum, titanium, plastics, or other materials based on factors such as their physical and chemical properties, cost of manufacture, durability, etc. In one preferred embodiment, sensing member 131 may be made of steel, more preferably a stainless steel, and signal member 132 may be made of plastic. In another embodiment, both members may be made of stainless steel.

It should be noted that other suitable embodiments of a one-piece, two-piece, or more energy-absorbing indicating elements are contemplated so long as the indicating elements are capable of being deformed or displaced to absorb impact energy in the presence of an applied external lateral force, and then return to their original undeformed or undisplaced positions when the lateral force is removed.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A method for indicating a loaded chamber condition of a firearm having an energy-absorbing indicating element, the method comprising:

loading a cartridge having a rim into a chamber of a firearm;

contacting a first portion of an indicating element with the cartridge rim;

pivoting the indicating element about a pivot in a first direction away from the chamber;

protruding a second portion of the indicating element at least partially outwards from the firearm to signal a loaded chamber condition to a user;

applying an external force against the second portion of the indicating element in an opposite second direction towards the chamber; and displacing inwardly the second portion of the indicating element with respect to the first portion of the indicating element while the cartridge rim contacts the first portion.

2. The method of claim 1, further comprising retracting the second portion at least partially back inside the firearm simultaneously with the step of displacing the second portion of the indicating element.

3. The method of claim 1, further comprising after the displacing step:

removing the force applied against the second portion of the indicating element; and protruding again the second portion outwards from inside the firearm.

4. The method of claim 1, further comprising a step of compressing a spring member with the second portion of the indicating element simultaneously with the step of displacing the second portion of the indicating element.

5. A method for indicating a loaded chamber condition of a firearm having an energy-absorbing indicating element, the method comprising:

providing an indicating element having a sensor portion and a signal portion spaced apart from and displaceable with respect to the sensor portion, the indicating element being movable between an expanded position and a collapsed position;

loading a cartridge having a rim into a chamber defined by the firearm with the indicating element being in the expanded position;

contacting the sensor portion of the indicating element with the cartridge rim;

pivoting the indicating element about a pivot in a direction away from the chamber; and protruding at least part of the signal portion of the indicating element outwards beyond an exterior surface of firearm, the indicating element being collapsible into the collapsed position when an external force directed inwards towards the chamber is applied against the protruding signal portion while the sensor portion is in contact with the cartridge rim.

6. The method of claim 5, wherein the signal portion is closer to the sensor portion in the collapsed position than in the expanded position.

7. The method of claim 5, further comprising the steps of:

applying an external force against the protruding signal portion of the indicating element in a direction towards the chamber; and collapsing the indicating element into the collapsed condition while contacting the sensor portion with the cartridge rim.

8. The method of claim 7, wherein collapsing the indicating element compresses a spring that acts to bias the indicating element into the expanded position.

9. The method of claim 5, wherein the indicating element includes a spring that biases the indicating element into the expanded position.

10. The method of claim 5, wherein the sensor portion is formed by a spring arm flexibly connected to the signal portion.

11. The method of claim 5, wherein the sensor portion is defined by a sensor member and the signal portion is defined by a signal member, the sensor and signal members being separately mounted about the pivot.

12. A method for indicating a loaded chamber condition of a firearm having an energy-absorbing indicating element, the method comprising:

providing an indicating element having a sensor portion and a signal portion spaced apart from the sensor portion and being displaceable with respect to the sensor portion, the indicating element being pivotally mounted inside the firearm;

locating the sensor portion proximate to a chamber of the firearm that receives a cartridge;

loading a cartridge having a rim into the chamber;

contacting the sensor portion with the cartridge rim;

pivoting the indicating element about a pivot in a direction away from the chamber so that at least part of the signal portion protrudes outwards from inside the firearm to signal a loaded chamber condition to a user; wherein when an external force directed towards the chamber is applied against the protruding signal portion, the signal portion is operative to be inwardly displaceable with respect to the sensor portion which remains stationary in contact with the cartridge rim.

13. The method of claim 12, further comprising the steps of:

applying the external force against the protruding signal portion; and at least partially retracting the signal portion inside the firearm.

14. The method of claim 12, wherein the indicating element is operative such that applying the external force against the protruding signal portion compresses a spring member acting on the signal portion.

15. The method of claim 12, wherein the indicating element is operative such that applying the external force against the protruding signal portion pivots the signal portion about the pivot towards the chamber while the sensor portion remains stationary in contact with the cartridge rim.

16. The method of claim 5, wherein the sensor portion is formed by a spring arm attached to the signal portion.

17. The method of claim 5, wherein the sensor portion is defined by a sensor member and the signal portion is defined by a signal member, the sensor and signal members being separately mounted about the pivot.

18. A method for indicating a loaded chamber condition of a firearm having an energy-absorbing indicating element, the method comprising:

providing a firearm having an indicating element pivotally mounted therein, the indicating element including a sensor portion and a signal portion spaced apart from the sensor portion and being displaceable with respect to the sensor portion;

positioning the signal portion inside the firearm and the sensor portion proximate to a chamber defined by the firearm that receives a cartridge;

loading a cartridge having a rim into the chamber;

contacting the sensor portion with the cartridge rim;

pivoting the indicating element about a pivot in an outwards direction away from the chamber so that at least part of the signal portion protrudes outwards from inside the firearm to signal a loaded chamber condition to a user; the indicating element being operative such that applying an external force directed towards the chamber against the protruding signal portion displaces the signal portion inwardly with respect to the sensor portion which remains stationary in contact with the cartridge rim.

19. The method of claim 18, wherein the indicating element is operative such that applying the external force against the protruding signal portion compresses a spring member acting on the signal portion.

20. The method of claim 18, wherein the sensor portion is spaced closer to the pivot than the signal portion.

* * * * *